US007997359B2

(12) United States Patent
Eason et al.

(10) Patent No.: US 7,997,359 B2
(45) Date of Patent: Aug. 16, 2011

(54) ABRASIVE WEAR-RESISTANT HARDFACING MATERIALS, DRILL BITS AND DRILLING TOOLS INCLUDING ABRASIVE WEAR-RESISTANT HARDFACING MATERIALS

(75) Inventors: Jimmy W. Eason, The Woodlands, TX (US); James L. Overstreet, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 154 days.

(21) Appl. No.: 11/862,719

(22) Filed: Sep. 27, 2007

(65) Prior Publication Data

US 2008/0073125 A1 Mar. 27, 2008

Related U.S. Application Data

(63) Continuation-in-part of application No. 11/513,677, filed on Aug. 30, 2006, now Pat. No. 7,703,555, which is a continuation-in-part of application No. 11/223,215, filed on Sep. 9, 2005, now Pat. No. 7,597,159.

(60) Provisional application No. 60/848,154, filed on Sep. 29, 2006.

(51) Int. Cl.
*E21B 10/36* (2006.01)

(52) U.S. Cl. ..... 175/425; 175/420.1

(58) Field of Classification Search ..... 175/420.1, 175/425; 419/14

See application file for complete search history.

(56) References Cited

U.S. PATENT DOCUMENTS

| | | | |
|---|---|---|---|
| 2,033,594 | A | 9/1931 | Stoody |
| 2,407,642 | A | 9/1946 | Ashworth |
| 2,660,405 | A | 11/1953 | Scott et al. |
| 2,740,651 | A | 4/1956 | Ortloff |
| 2,819,958 | A | 1/1958 | Abkowitz et al. |
| 2,819,959 | A | 1/1958 | Abkowitz et al. |
| 2,906,654 | A | 9/1959 | Abkowitz |
| 2,961,312 | A | 11/1960 | Elbaum |
| 3,158,214 | A | 11/1964 | Wisler et al. |
| 3,180,440 | A | 4/1965 | Bridwell |
| 3,260,579 | A | 7/1966 | Scales et al. |
| 3,368,881 | A | 2/1968 | Abkowitz et al. |
| 3,471,921 | A | 10/1969 | Feenstra |
| 3,660,050 | A | 5/1972 | Iler et al. |
| 3,727,704 | A | 4/1973 | Abplanalp |

(Continued)

FOREIGN PATENT DOCUMENTS

AU 695583 2/1998

(Continued)

OTHER PUBLICATIONS

Smith International, Inc., Smith Bits Product Catalog 2005-2006, p. 45.

(Continued)

*Primary Examiner* — William P Neuder
*Assistant Examiner* — Cathleen R Hutchins
(74) *Attorney, Agent, or Firm* — TraskBritt

(57) ABSTRACT

An abrasive wear-resistant material includes a matrix material and a plurality of −40/+80 ASTM mesh dense sintered carbide pellets. A rotary drill bit having an exterior surface and an abrasive wear-resistant material disposed on at least a portion of the exterior surface of the bit body is provided. Methods for applying an abrasive wear-resistant material to a surface of a drill bit are also disclosed.

16 Claims, 16 Drawing Sheets

U.S. PATENT DOCUMENTS

| | | | | |
|---|---|---|---|---|
| 3,757,879 | A | | 9/1973 | Wilder et al. |
| 3,768,984 | A | | 10/1973 | Foster, Jr. |
| 3,790,353 | A | | 2/1974 | Jackson et al. |
| 3,800,891 | A | | 4/1974 | White et al. |
| 3,942,954 | A | | 3/1976 | Frehn |
| 3,987,859 | A | | 10/1976 | Lichte |
| 3,989,554 | A | | 11/1976 | Wisler |
| 4,017,480 | A | | 4/1977 | Baum |
| 4,043,611 | A | | 8/1977 | Wallace |
| 4,047,828 | A | | 9/1977 | Makely |
| 4,059,217 | A | | 11/1977 | Woodward |
| 4,094,709 | A | | 6/1978 | Rozmus |
| 4,128,136 | A | | 12/1978 | Generoux |
| 4,173,457 | A | | 11/1979 | Smith |
| 4,198,233 | A | | 4/1980 | Frehn |
| 4,221,270 | A | | 9/1980 | Vezirian |
| 4,229,638 | A | | 10/1980 | Lichte |
| 4,233,720 | A | | 11/1980 | Rozmus |
| 4,243,727 | A | | 1/1981 | Wisler et al. |
| 4,252,202 | A | | 2/1981 | Purser, Sr. |
| 4,255,165 | A | | 3/1981 | Dennis et al. |
| 4,262,761 | A | | 4/1981 | Crow |
| 4,306,139 | A | | 12/1981 | Shinozaki et al. |
| 4,341,557 | A | | 7/1982 | Lizenby |
| 4,389,952 | A | | 6/1983 | Dreier et al. |
| 4,398,952 | A | | 8/1983 | Drake |
| 4,414,029 | A | | 11/1983 | Newman et al. |
| 4,455,278 | A | | 6/1984 | van Nederveen et al. |
| 4,499,048 | A | | 2/1985 | Hanejko |
| 4,499,795 | A | | 2/1985 | Radtke |
| 4,499,958 | A | | 2/1985 | Radtke et al. |
| 4,526,748 | A | | 7/1985 | Rozmus |
| 4,547,337 | A | | 10/1985 | Rozmus |
| 4,552,232 | A | | 11/1985 | Frear |
| 4,554,130 | A | | 11/1985 | Ecer |
| 4,562,892 | A | | 1/1986 | Ecer |
| 4,562,990 | A | | 1/1986 | Rose |
| 4,579,713 | A | | 4/1986 | Lueth |
| 4,596,694 | A | | 6/1986 | Rozmus |
| 4,597,456 | A | | 7/1986 | Ecer |
| 4,597,730 | A | | 7/1986 | Rozmus |
| 4,611,673 | A | | 9/1986 | Childers et al. |
| 4,630,692 | A | | 12/1986 | Ecer |
| 4,630,693 | A | | 12/1986 | Goodfellow |
| 4,656,002 | A | | 4/1987 | Lizenby et al. |
| 4,666,797 | A | | 5/1987 | Newman et al. |
| 4,667,756 | A | | 5/1987 | King et al. |
| 4,674,802 | A | | 6/1987 | McKenna et al. |
| 4,676,124 | A | | 6/1987 | Fischer |
| 4,686,080 | A | | 8/1987 | Hara et al. |
| 4,694,919 | A | | 9/1987 | Barr |
| 4,726,432 | A | | 2/1988 | Scott et al. |
| 4,743,515 | A | | 5/1988 | Fischer et al. |
| 4,744,943 | A | | 5/1988 | Timm |
| 4,762,028 | A | | 8/1988 | Regan |
| 4,781,770 | A | | 11/1988 | Kar |
| 4,809,903 | A | | 3/1989 | Eylon et al. |
| 4,814,234 | A | | 3/1989 | Bird |
| 4,836,307 | A | * | 6/1989 | Keshavan et al. ..... 175/374 |
| 4,838,366 | A | | 6/1989 | Jones |
| 4,871,377 | A | | 10/1989 | Frushour |
| 4,884,477 | A | | 12/1989 | Smith et al. |
| 4,889,017 | A | | 12/1989 | Fuller et al. |
| 4,919,013 | A | | 4/1990 | Smith et al. |
| 4,923,512 | A | | 5/1990 | Timm et al. |
| 4,933,240 | A | | 6/1990 | Barber, Jr. |
| 4,938,991 | A | | 7/1990 | Bird |
| 4,944,774 | A | | 7/1990 | Keshavan et al. |
| 4,956,012 | A | | 9/1990 | Jacobs et al. |
| 4,968,348 | A | | 11/1990 | Abkowitz et al. |
| 5,000,273 | A | | 3/1991 | Horton et al. |
| 5,010,225 | A | | 4/1991 | Carlin |
| 5,030,598 | A | | 7/1991 | Hsieh |
| 5,032,352 | A | | 7/1991 | Meeks et al. |
| 5,038,640 | A | | 8/1991 | Sullivan et al. |
| 5,049,450 | A | | 9/1991 | Dorfman et al. |
| 5,051,112 | A | | 9/1991 | Keshavan et al. |
| 5,089,182 | A | | 2/1992 | Findeisen et al. |
| 5,090,491 | A | | 2/1992 | Tibbits et al. |
| 5,101,692 | A | | 4/1992 | Simpson |
| 5,150,636 | A | | 9/1992 | Hill |
| 5,152,194 | A | | 10/1992 | Keshavan et al. |
| 5,161,898 | A | | 11/1992 | Drake |
| 5,186,267 | A | | 2/1993 | White |
| 5,232,522 | A | | 8/1993 | Doktycz et al. |
| 5,242,017 | A | | 9/1993 | Hailey |
| 5,250,355 | A | | 10/1993 | Newman et al. |
| 5,281,260 | A | | 1/1994 | Kumar et al. |
| 5,286,685 | A | | 2/1994 | Schoennahl et al. |
| 5,291,807 | A | | 3/1994 | Vanderford et al. |
| 5,311,958 | A | | 5/1994 | Isbell et al. |
| 5,328,763 | A | | 7/1994 | Terry |
| 5,348,806 | A | | 9/1994 | Kojo et al. |
| 5,373,907 | A | | 12/1994 | Weaver |
| 5,433,280 | A | | 7/1995 | Smith |
| 5,439,068 | A | | 8/1995 | Huffstutler et al. |
| 5,443,337 | A | | 8/1995 | Katayama |
| 5,479,997 | A | | 1/1996 | Scott et al. |
| 5,482,670 | A | | 1/1996 | Hong |
| 5,484,468 | A | | 1/1996 | Ostlund et al. |
| 5,492,186 | A | | 2/1996 | Overstreet et al. |
| 5,506,055 | A | | 4/1996 | Dorfman et al. |
| 5,535,838 | A | | 7/1996 | Keshavan et al. |
| 5,543,235 | A | | 8/1996 | Mirchandani et al. |
| 5,544,550 | A | | 8/1996 | Smith |
| 5,560,440 | A | | 10/1996 | Tibbitts |
| 5,586,612 | A | | 12/1996 | Isbell et al. |
| 5,589,268 | A | * | 12/1996 | Kelley et al. ..... 428/408 |
| 5,593,474 | A | | 1/1997 | Keshavan et al. |
| 5,611,251 | A | | 3/1997 | Katayama |
| 5,612,264 | A | | 3/1997 | Nilsson et al. |
| 5,641,251 | A | | 6/1997 | Leins et al. |
| 5,641,921 | A | | 6/1997 | Dennis et al. |
| 5,653,299 | A | | 8/1997 | Sreshta et al. |
| 5,662,183 | A | | 9/1997 | Fang |
| 5,663,512 | A | | 9/1997 | Schader et al. |
| 5,666,864 | A | | 9/1997 | Tibbitts |
| 5,677,042 | A | | 10/1997 | Massa et al. |
| 5,679,445 | A | | 10/1997 | Massa et al. |
| 5,697,046 | A | | 12/1997 | Conley |
| 5,697,462 | A | | 12/1997 | Grimes et al. |
| 5,732,783 | A | | 3/1998 | Truax et al. |
| 5,733,649 | A | | 3/1998 | Kelley et al. |
| 5,733,664 | A | | 3/1998 | Kelley et al. |
| 5,740,872 | A | | 4/1998 | Smith |
| 5,753,160 | A | | 5/1998 | Takeuchi et al. |
| 5,755,298 | A | | 5/1998 | Langford, Jr. et al. |
| 5,765,095 | A | | 6/1998 | Flak et al. |
| 5,776,593 | A | | 7/1998 | Massa et al. |
| 5,778,301 | A | | 7/1998 | Hong |
| 5,789,686 | A | | 8/1998 | Massa et al. |
| 5,791,422 | A | | 8/1998 | Liang et al. |
| 5,791,423 | A | | 8/1998 | Overstreet et al. |
| 5,792,403 | A | | 8/1998 | Massa et al. |
| 5,806,934 | A | | 9/1998 | Massa et al. |
| 5,830,256 | A | | 11/1998 | Northrop et al. |
| 5,856,626 | A | | 1/1999 | Fischer et al. |
| 5,865,571 | A | | 2/1999 | Tankala et al. |
| 5,880,382 | A | | 3/1999 | Fang et al. |
| 5,893,204 | A | | 4/1999 | Symonds |
| 5,896,940 | A | | 4/1999 | Pietrobelli et al. |
| 5,897,830 | A | | 4/1999 | Abkowitz et al. |
| 5,904,212 | A | | 5/1999 | Arfele |
| 5,921,330 | A | | 7/1999 | Sue et al. |
| 5,924,502 | A | | 7/1999 | Arfele et al. |
| 5,954,147 | A | | 9/1999 | Overstreet |
| 5,957,006 | A | | 9/1999 | Smith |
| 5,963,775 | A | | 10/1999 | Fang |
| 5,967,248 | A | | 10/1999 | Drake et al. |
| 5,988,302 | A | | 11/1999 | Sreshta et al. |
| 5,988,303 | A | | 11/1999 | Arfele |
| 6,009,961 | A | | 1/2000 | Pietrobelli et al. |
| 6,029,544 | A | | 2/2000 | Katayama |
| 6,045,750 | A | | 4/2000 | Drake et al. |
| 6,051,171 | A | | 4/2000 | Takeuchi et al. |
| 6,063,333 | A | | 5/2000 | Dennis |
| 6,068,070 | A | | 5/2000 | Scott |

| | | | | |
|---|---|---|---|---|
| 6,073,518 | A | 6/2000 | Chow et al. | |
| 6,086,980 | A | 7/2000 | Foster et al. | |
| 6,089,123 | A | 7/2000 | Chow et al. | |
| 6,099,664 | A | 8/2000 | Davies et al. | |
| 6,124,564 | A | 9/2000 | Sue et al. | |
| 6,131,677 | A | 10/2000 | Arfele et al. | |
| 6,148,936 | A | 11/2000 | Evans et al. | |
| 6,196,338 | B1 | 3/2001 | Slaughter et al. | |
| 6,200,514 | B1 | 3/2001 | Meister | |
| 6,206,115 | B1 | 3/2001 | Overstreet et al. | |
| RE37,127 | E | 4/2001 | Schader et al. | |
| 6,209,420 | B1 | 4/2001 | Butcher et al. | |
| 6,214,134 | B1 | 4/2001 | Eylon et al. | |
| 6,214,287 | B1 | 4/2001 | Waldenstrom | |
| 6,220,117 | B1 | 4/2001 | Butcher | |
| 6,227,188 | B1 | 5/2001 | Tankala et al. | |
| 6,228,139 | B1 | 5/2001 | Oskarsson | |
| 6,234,261 | B1 * | 5/2001 | Evans et al. | 175/374 |
| 6,241,036 | B1 | 6/2001 | Lovato et al. | |
| 6,248,149 | B1 | 6/2001 | Massey et al. | |
| 6,254,658 | B1 | 7/2001 | Taniuchi et al. | |
| 6,287,360 | B1 | 9/2001 | Kembaiyan et al. | |
| 6,290,438 | B1 | 9/2001 | Papajewski | |
| 6,293,986 | B1 | 9/2001 | Rodiger et al. | |
| 6,348,110 | B1 | 2/2002 | Evans | |
| 6,349,780 | B1 | 2/2002 | Beuershausen | |
| 6,360,832 | B1 | 3/2002 | Overstreet et al. | |
| 6,375,706 | B2 | 4/2002 | Kembaiyan et al. | |
| 6,450,271 | B1 | 9/2002 | Tibbitts et al. | |
| 6,453,899 | B1 | 9/2002 | Tselesin | |
| 6,454,025 | B1 | 9/2002 | Runquist et al. | |
| 6,454,028 | B1 | 9/2002 | Evans | |
| 6,454,030 | B1 | 9/2002 | Findley et al. | |
| 6,458,471 | B2 | 10/2002 | Lovato et al. | |
| 6,474,425 | B1 | 11/2002 | Truax et al. | |
| 6,500,226 | B1 | 12/2002 | Dennis | |
| 6,511,265 | B1 | 1/2003 | Micrhandani et al. | |
| 6,568,491 | B1 | 5/2003 | Matthews, III et al. | |
| 6,575,350 | B2 | 6/2003 | Evans et al. | |
| 6,576,182 | B1 | 6/2003 | Ravagni et al. | |
| 6,589,640 | B2 | 7/2003 | Griffin et al. | |
| 6,599,467 | B1 | 7/2003 | Yamaguchi et al. | |
| 6,607,693 | B1 | 8/2003 | Saito et al. | |
| 6,615,936 | B1 | 9/2003 | Mourik et al. | |
| 6,651,756 | B1 | 11/2003 | Costo et al. | |
| 6,655,481 | B2 | 12/2003 | Findley | |
| 6,659,206 | B2 | 12/2003 | Liang et al. | |
| 6,663,688 | B2 | 12/2003 | Findeisen et al. | |
| 6,685,880 | B2 | 2/2004 | Engstrom et al. | |
| 6,725,952 | B2 | 4/2004 | Singh | |
| 6,742,608 | B2 | 6/2004 | Murdoch | |
| 6,742,611 | B1 | 6/2004 | Illerhaus et al. | |
| 6,756,009 | B2 | 6/2004 | Sim et al. | |
| 6,766,870 | B2 | 7/2004 | Overstreet | |
| 6,772,849 | B2 | 8/2004 | Oldham et al. | |
| 6,782,958 | B2 | 8/2004 | Liang et al. | |
| 6,849,231 | B2 | 2/2005 | Kojima et al. | |
| 6,861,612 | B2 | 3/2005 | Bolton et al. | |
| 6,918,942 | B2 | 7/2005 | Hatta et al. | |
| 6,948,403 | B2 | 9/2005 | Singh | |
| 7,044,243 | B2 | 5/2006 | Kembaiyan et al. | |
| 7,048,081 | B2 | 5/2006 | Smith et al. | |
| 7,240,746 | B2 | 7/2007 | Overstreet et al. | |
| 7,703,555 | B2 | 4/2010 | Overstreet | |
| 2001/0015290 | A1 | 8/2001 | Sue et al. | |
| 2001/0017224 | A1 | 8/2001 | Evans et al. | |
| 2002/0004105 | A1 | 1/2002 | Kunze et al. | |
| 2003/0010409 | A1 | 1/2003 | Kunze et al. | |
| 2004/0013558 | A1 | 1/2004 | Kondoh et al. | |
| 2004/0060742 | A1 | 4/2004 | Kembaiyan et al. | |
| 2004/0196638 | A1 | 10/2004 | Lee et al. | |
| 2004/0234821 | A1 | 11/2004 | Majagi | |
| 2004/0243241 | A1 | 12/2004 | Istephanous et al. | |
| 2004/0245022 | A1 | 12/2004 | Izaguirre et al. | |
| 2004/0245024 | A1 | 12/2004 | Kembaiyan | |
| 2005/0000317 | A1 * | 1/2005 | Liang et al. | 75/241 |
| 2005/0008524 | A1 | 1/2005 | Testani | |
| 2005/0072496 | A1 | 4/2005 | Hwang et al. | |
| 2005/0084407 | A1 | 4/2005 | Myrick | |
| 2005/0117984 | A1 | 6/2005 | Eason et al. | |
| 2005/0126334 | A1 | 6/2005 | Mirchandani | |
| 2005/0211475 | A1 | 9/2005 | Mirchandani et al. | |
| 2005/0247491 | A1 | 11/2005 | Mirchandani et al. | |
| 2005/0268746 | A1 | 12/2005 | Abkowitz et al. | |
| 2006/0016521 | A1 | 1/2006 | Hanusiak et al. | |
| 2006/0032677 | A1 | 2/2006 | Azar et al. | |
| 2006/0043648 | A1 | 3/2006 | Takeuchi et al. | |
| 2006/0057017 | A1 | 3/2006 | Woodfield et al. | |
| 2006/0131081 | A1 | 6/2006 | Mirchandani et al. | |
| 2006/0185908 | A1 | 8/2006 | Kembaiyan et al. | |
| 2007/0042217 | A1 | 2/2007 | Fang et al. | |
| 2007/0056777 | A1 | 3/2007 | Overstreet | |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2007/0163812 | A1 | 7/2007 | Overstreet et al. | |
| 2007/0205023 | A1 | 9/2007 | Hoffmaster et al. | |
| 2008/0053709 | A1 | 3/2008 | Lockstedt et al. | |
| 2008/0083568 | A1 | 4/2008 | Overstreet | |
| 2009/0113811 | A1 | 5/2009 | Overstreet | |
| 2010/0000798 | A1 | 1/2010 | Patel | |
| 2010/0132265 | A1 | 6/2010 | Overstreet | |

FOREIGN PATENT DOCUMENTS

| | | | |
|---|---|---|---|
| CA | 2212197 | | 10/2000 |
| EP | 0 264 674 | A2 | 4/1988 |
| EP | 0 453 428 | A1 | 10/1991 |
| EP | 0 995 876 | A2 | 4/2000 |
| EP | 1 244 531 | B1 | 10/2002 |
| GB | 945227 | | 12/1963 |
| GB | 1070039 | | 5/1967 |
| GB | 2104101 | A | 3/1983 |
| GB | 2203774 | A | 10/1988 |
| GB | 2295157 | A | 5/1996 |
| GB | 2352727 | A | 2/2001 |
| GB | 2347788 | A | 4/2001 |
| GB | 2357788 | A | 4/2001 |
| GB | 2 385 350 | A | 8/2003 |
| GB | 2 393 449 | A | 3/2004 |
| JP | 10 219385 | A | 8/1998 |
| WO | 03049889 | A2 | 6/2003 |
| WO | 2004053197 | A2 | 6/2004 |
| WO | 2006099629 | A1 | 9/2006 |
| WO | 2007030707 | A1 | 3/2007 |

OTHER PUBLICATIONS

PCT International Search Report for PCT/US2007/021072, mailed Feb. 27, 2008.

"Boron Carbide Nozzles and Inserts," Seven Stars International webpage http://www.concentric.net/~ctkang/nozzle.shtml, printed Sep. 7, 2006.

"Heat Treating of Titanium and Titanium Alloys," Key to Metals website article, www.key-to-metals.com, (no date).

Alman, D.E., et al., "The Abrasive Wear of Sintered Titanium Matrix-Ceramic Particle Reinforced Composites," WEAR, 225-229 (1999), pp. 629-639.

Choe, Heeman, et al., "Effect of Tungsten Additions on the Mechanical Properties of Ti-6A1-4V," Material Science and Engineering, A 396 (2005), pp. 99-106, Elsevier.

Diamond Innovations, "Composite Diamond Coatings, Superhard Protection of Wear Parts New Coating and Service Parts from Diamond Innovations" brochure, 2004.

Gale, W.F., et al., Smithells Metals Reference Book, Eighth Edition, 2003, p. 2,117, Elsevier Butterworth Heinemann.

Miserez, A., et al. "Particle Reinforced Metals of High Ceramic Content," Material Science and Engineering A 387-389 (2004), pp. 822-831, Elsevier.

PCT International Search Report PCT Counterpart Application No. PCT/US2006/043669, mailed Apr. 13, 2007.

PCT International Search Report for PCT Counterpart Application No. PCT/US2006/043670, mailed Apr. 2, 2007.

Reed, James S., "Chapter 13: Particle Packing Characteristics," Principles of Ceramics Processing, Second Edition, John Wiley & Sons, Inc. (1995), pp. 215-227.

PCT International Search Report for PCT Counterpart Application No. PCT/US06/35010, dated Dec. 27, 2006.
PCT International Search Report for International Application PCT/US2007/019085, mailed Jan. 31, 2008.
www.matweb.com "Wall Comonoy Colmonoy 4 Hard-surfacing alloy with chromium boride" from www.matweb.com, 1 page, printed Mar. 19, 2009.
Wall Colmonoy "Colmonoy Alloy Selector Chart" 2003, pp. 1 and 2.
Warrier, S.G., et al., "Infiltration of Titanium Alloy-Matrix Composites," Journal of Materials Science Letters, 12 (1993), pp. 865-868, Champman & Hall.
PCT International Search Report for PCT/US2007/021071, mailed Feb. 6, 2008.
PCT International Search Report for counterpart PCT International Application No. PCT/US2007/023275, mailed Apr. 11, 2008.
B & W Metals, Kutrite, http://www.bwmetals.com,1 page (no date).
B & W Metals, "Today we're more then just Kutrite © composite rods . . . much more!," Houston, Texas, 2 pages (no date).
International Search Report for WO 2007/030707 A1 (PCT/US2006/035010), mailed Dec. 27, 2006 (3 pages).
International Application Search Report for International Application No. PCT/US2009/048232 mailed Feb. 2, 2010, 5 pages.
Written Opinion for International Application No. PCT/US2009/048232 mailed Feb. 2, 2010, 4 pages.
PCT Written Opinion for PCT International Application No. PCT/US2007/023275, mailed Apr. 11, 2008.
PCT Written Opinion for PCT International Application No. PCT/US2006/043670, mailed Apr. 2, 2007.
PCT Written Opinion for PCT International Application No. PCT/US2007/021071, mailed Feb. 6, 2008.
PCT Written Opinion for PCT International Application No. PCT/US2006/043669, mailed Apr. 13, 2007.
PCT Written Opinion for PCT International Application No. PCT/US2007/021072, mailed Feb. 27, 2008.
PCT Written Opinion for PCT International Application No. PCT/US2007/019085, dated Jan. 31, 2008.
PCT Written Opinion for PCT International Application No. PCT/US06/35010, dated Dec. 27, 2006.
US 4,966,627, 10/1990, Keshavan et al. (withdrawn)

* cited by examiner

ABRASIVE WEAR-RESISTANT HARDFACING MATERIALS, DRILL BITS AND DRILLING TOOLS INCLUDING ABRASIVE WEAR-RESISTANT HARDFACING MATERIALS

PRIORITY CLAIM

This application claims the benefit of U.S. Application Ser. No. 60/848,154, filed Sep. 29, 2006, and is a continuation-in-part of U.S. application Ser. No. 11/513,677, filed Aug. 30, 2006, now U.S. Pat. No. 7,703,555, issued Apr. 27, 2010; and a continuation-in-part of U.S. application Ser. No. 11/223,215, filed Sep. 9, 2005, now U.S. Patent No. 7,597,159, issued Oct. 6, 2009, the disclosure of each of which application is incorporated herein in its entirety by this reference.

FIELD OF THE INVENTION

The invention generally relates to drill bits and other tools that may be used in drilling subterranean formations, and to abrasive wear-resistant hardfacing materials that may be used on surfaces of such drill bits and tools. The invention also relates to methods for applying abrasive wear-resistant hardfacing to surfaces of drill bits and tools.

BACKGROUND OF RELATED ART

A conventional fixed-cutter, or "drag," rotary drill bit for drilling subterranean formations includes a bit body having a face region thereon carrying cutting elements for cutting into an earth formation. The bit body may be secured to a hardened steel shank having a threaded pin connection, such as an API threaded pin, for attaching the drill bit to a drill string that includes tubular pipe segments coupled end to end between the drill bit and other drilling equipment. Equipment such as a rotary table or top drive may be used for rotating the tubular pipe and drill bit. Alternatively, the shank may be coupled to the drive shaft of a down hole motor to rotate the drill bit independently of, or in conjunction with, a rotary table or top drive.

Typically, the bit body of a drill bit is formed from steel or a combination of a steel blank embedded in a particle-matrix composite material that includes hard particulate material, such as tungsten carbide, infiltrated with a molten binder material such as a copper alloy. The hardened steel shank generally is secured to the bit body after the bit body has been formed. Structural features may be provided at selected locations on and in the bit body to facilitate the drilling process. Such structural features may include, for example, radially and longitudinally extending blades, cutting element pockets, ridges, lands, nozzle ports, and drilling fluid courses and passages. The cutting elements generally are secured to cutting element pockets that are machined into blades located on the face region of the bit body, e.g., the leading edges of the radially and longitudinally extending blades. These structural features, such as the cutting element pockets, may also be formed by a mold used to form the bit body when the molten binder material is infiltrated into the hard particulate material. Advantageously, a particle-matrix composite material provides a bit body of higher strength and toughness compared to steel material, but still is subject to slurry erosion and abrasive wear, particularly on lower stress surface areas of the drill bit. Therefore, it would be desirable to provide a method of manufacturing suitable for producing a bit body that includes hardfacing materials that are less prone to slurry erosion and wear.

Generally, most or all of the cutting elements of a conventional fixed-cutter rotary drill bit for drilling soft and medium formations each include a cutting surface comprising a hard, superabrasive material such as mutually bound particles of polycrystalline diamond. Such "polycrystalline diamond compact" (PDC) cutters have been employed on fixed-cutter rotary drill bits in the oil and gas well drilling industries for several decades.

FIG. 1 illustrates a conventional fixed-cutter rotary drill bit 10 generally according to the description above. The rotary drill bit 10 includes a bit body 12 that is coupled to a steel shank 14. A bore (not shown) is formed longitudinally through a portion of the drill bit 10 for communicating drilling fluid to a face 20 of the drill bit 10 via nozzles 19 during drilling operations. Cutting elements 22 (typically polycrystalline diamond compact (PDC) cutting elements) generally are bonded to the face 20 of the bit body 12 by methods such as brazing, adhesive bonding, or mechanical affixation.

A drill bit 10 may be used numerous times to perform successive drilling operations during which the surfaces of the bit body 12 and cutting elements 22 may be subjected to extreme forces and stresses as the cutting elements 22 of the drill bit 10 shear away the underlying earth formation. These extreme forces and stresses cause the cutting elements 22 and the surfaces of the bit body 12 to wear. Eventually, the surfaces of the bit body 12 may wear to an extent at which the drill bit 10 is no longer suitable for use. Therefore, there is a need in the art for enhancing the wear-resistance of the surfaces of the body 12. Also, the cutting elements 22 may wear to an extent at which they are no longer suitable for use.

FIG. 2 is an enlarged view of a PDC cutting element 22 like those shown in FIG. 1 secured to the bit body 12. Typically, the cutting elements 22 are fabricated separately from the bit body 12 and secured within pockets 21 formed in the outer, or exterior, surface of the bit body 12 with a bonding material 24 such as an adhesive or, more typically, a braze alloy as previously discussed herein. Furthermore, if the cutting element 22 is a PDC cutter, the cutting element 22 may include a polycrystalline diamond compact table 28 secured to a cutting element body or substrate 23, which may be unitary or comprise two components bonded together.

Conventional bonding material 24 is much less resistant to wear than are other portions and surfaces of the drill bit 10 and of cutting elements 22. During use, small vugs, voids and other defects may be formed in exposed surfaces of the bonding material 24 due to wear. Solids-laden drilling fluids and formation debris generated during the drilling process may further erode, abrade and enlarge the small vugs and voids in the bonding material 24 even though partially shielded from the higher stresses caused by formation cutting. The entire cutting element 22 may separate from the drill bit body 12 during a drilling operation if enough bonding material 24 is removed. Loss of a cutting element 22 during a drilling operation can lead to rapid wear of other cutting elements and catastrophic failure of the entire drill bit 10. Therefore, there is also a need in the art for an effective method for enhancing the wear-resistance of the bonding material to help prevent the loss of cutting elements during drilling operations.

Ideally, the materials of a rotary drill bit must be extremely hard to withstand abrasion and erosion attendant to drilling earth formations without excessive wear. Due to the extreme forces and stresses to which drill bits are subjected during drilling operations, the materials of an ideal drill bit must simultaneously exhibit high fracture toughness. In practicality, however, materials that exhibit extremely high hardness tend to be relatively brittle and do not exhibit high fracture toughness, while materials exhibiting high fracture toughness tend to be relatively soft and do not exhibit high hardness. As a result, a compromise must be made between hardness and fracture toughness when selecting materials for use in drill bits.

In an effort to simultaneously improve both the hardness and fracture toughness of rotary drill bits, composite materials have been applied to the surfaces of drill bits that are subjected to extreme wear. These composite or hard particle materials are often referred to as "hardfacing" materials and typically include at least one phase that exhibits relatively high hardness and another phase that exhibits relatively high fracture toughness.

FIG. 3 is a representation of a photomicrograph of a polished and etched surface of a conventional hardfacing material applied upon the particulate-matrix composite material, as mentioned above, of a bit body. The hardfacing material includes tungsten carbide particles 40 substantially randomly dispersed throughout an iron-based matrix of matrix material 46. The tungsten carbide particles 40 exhibit relatively high hardness, while the matrix material 46 exhibits relatively high fracture toughness.

Tungsten carbide particles 40 used in hardfacing materials may comprise one or more of cast tungsten carbide particles, sintered tungsten carbide particles, and macrocrystalline tungsten carbide particles. The tungsten carbide system includes two stoichiometric compounds, WC and W2C, with a continuous range of mixtures therebetween. Cast tungsten carbide generally includes a eutectic mixture of the WC and W2C compounds. Sintered tungsten carbide particles include relatively smaller particles of WC bonded together by a matrix material. Cobalt and cobalt alloys are often used as matrix materials in sintered tungsten carbide particles. Sintered tungsten carbide particles can be formed by mixing together a first powder that includes the relatively smaller tungsten carbide particles and a second powder that includes cobalt particles. The powder mixture is formed in a "green" state. The green powder mixture then is sintered at a temperature near the melting temperature of the cobalt particles to form a matrix of cobalt material surrounding the tungsten carbide particles to form particles of sintered tungsten carbide. Finally, macrocrystalline tungsten carbide particles generally consist of single crystals of WC.

Various techniques known in the art may be used to apply a hardfacing material such as that represented in FIG. 3 to a surface of a drill bit. A welding rod may be configured as a hollow, cylindrical tube formed from the matrix material of the hardfacing material that is filled with tungsten carbide particles. At least one end of the hollow, cylindrical tube may be sealed. The sealed end of the tube then may be melted or welded onto the desired surface on the drill bit. As the tube melts, the tungsten carbide particles within the hollow, cylindrical tube mix with and are suspended in the molten matrix material as it is deposited onto the drill bit. An alternative technique involves forming a cast rod of the hardfacing material and using either an arc or a torch to apply or weld hardfacing material disposed at an end of the rod to the desired surface on the drill bit. One method of applying the hardfacing material by torch is to use what is known as oxy fuel gas welding. Oxy fuel gas welding is a group of welding processes which produces coalescence by heating materials with an oxy fuel gas flame or flames with or without the application of pressure to apply the hardfacing material. One so-called "oxy fuel gas welding" is known as oxygen-acetylene welding (OAW), which is a well accepted method for applying a hardfacing material to a surface of a drill bit.

Arc welding techniques also may be used to apply a hardfacing material to a surface of a drill bit. For example, a plasma transferred arc may be established between an electrode and a region on a surface of a drill bit on which it is desired to apply a hardfacing material. A powder mixture including both particles of tungsten carbide and particles of matrix material then may be directed through or proximate the plasma-transferred arc onto the region of the surface of the drill bit. The heat generated by the arc melts at least the particles of matrix material to form a weld pool on the surface of the drill bit, which subsequently solidifies to form the hardfacing material layer on the surface of the drill bit.

When a hardfacing material is applied to a surface of a drill bit, relatively high temperatures are used to melt at least the matrix material. At these relatively high temperatures, dissolution may occur between the tungsten carbide particles and the matrix material. In other words, after applying the hardfacing material, at least some atoms originally contained in a tungsten carbide particle (tungsten and carbon, for example) may be found in the matrix material surrounding the tungsten carbide particle. In addition, at least some atoms originally contained in the matrix material (iron, for example) may be found in the tungsten carbide particles. FIG. 4 is an enlarged view of a tungsten carbide particle 40 shown in FIG. 3. At least some atoms originally contained in the tungsten carbide particle 40 (tungsten and carbon, for example) may be found in a region 47 of the matrix material 46 immediately surrounding the tungsten carbide particle 40. The region 47 roughly includes the region of the matrix material 46 enclosed within the phantom line 48. In addition, at least some atoms originally contained in the matrix material 46 (iron, for example) may be found in a peripheral or outer region 41 of the tungsten carbide particle 40. The outer region 41 roughly includes the region of the tungsten carbide particle 40 outside the phantom line 42.

Dissolution between the tungsten carbide particle 40 and the matrix material 46 may embrittle the matrix material 46 in the region 47 surrounding the tungsten carbide particle 40 and reduce the hardness of the tungsten carbide particle 40 in the outer region 41 thereof, reducing the overall effectiveness of the hardfacing material. Dissolution is the process of dissolving a solid, such as the tungsten carbide particle 40, into a liquid, such as the matrix material 46, particularly when at elevated temperatures and when the matrix material 46 is in its liquid phase, which transforms the material composition of the matrix material. In one aspect, dissolution is the process where a solid substance enters (generally at elevated temperatures) a molten matrix material that changes the composition of the matrix material. Dissolution occurs more rapidly as the temperature of the matrix material 46 approaches the melting temperature of tungsten carbide particle 40. For example, an iron-based matrix material will have greater dissolution of the tungsten carbide particles 40 than a nickel-based matrix material will, because of the higher temperatures required in order to bring the iron-based matrix material into a molten state during application. With a change in the composition of the matrix material, the material also becomes more sensitive to slurry erosion and wear, particularly on lower stress surface areas of the drill bit and bit body. Therefore, there is a need in the art for abrasive wear-resistant hardfacing materials that include a matrix material that allows for dissolution between tungsten carbide particles and the matrix material to be minimized. There is also a need in the art for methods of applying such abrasive wear-resistant hardfacing materials to surfaces of particle-matrix composite drill bits, and for drill bits and drilling tools that include such particle-matrix composite materials.

BRIEF SUMMARY OF THE INVENTION

A rotary drill bit is provided that includes an abrasive wear-resistant material, which may be characterized as a "hardfacing" material, for enhancing the wear-resistance of surfaces of the drill bit.

In embodiments of the invention, a rotary drill bit includes a bit body having an exterior surface and an abrasive wear-resistant material disposed on the exterior surface of the bit body, the abrasive wear-resistant material comprising a particle-matrix composite material having reduced dissolution.

Methods for applying an abrasive wear-resistant material to a surface of a drill bit in accordance with embodiments of the invention are also provided.

Other advantages, features and alternative aspects of the invention will become apparent when viewed in light of the detailed description of the various embodiments of the invention when taken in conjunction with the attached drawings and appended claims.

BRIEF DESCRIPTION OF THE DRAWINGS

While the specification concludes with claims particularly pointing out and distinctly claiming that which is regarded as the invention, the advantages of this invention may be more readily ascertained from the following description of the invention when read in conjunction with the accompanying drawings in which:

DETAILED DESCRIPTION OF THE INVENTION

Figure 1:
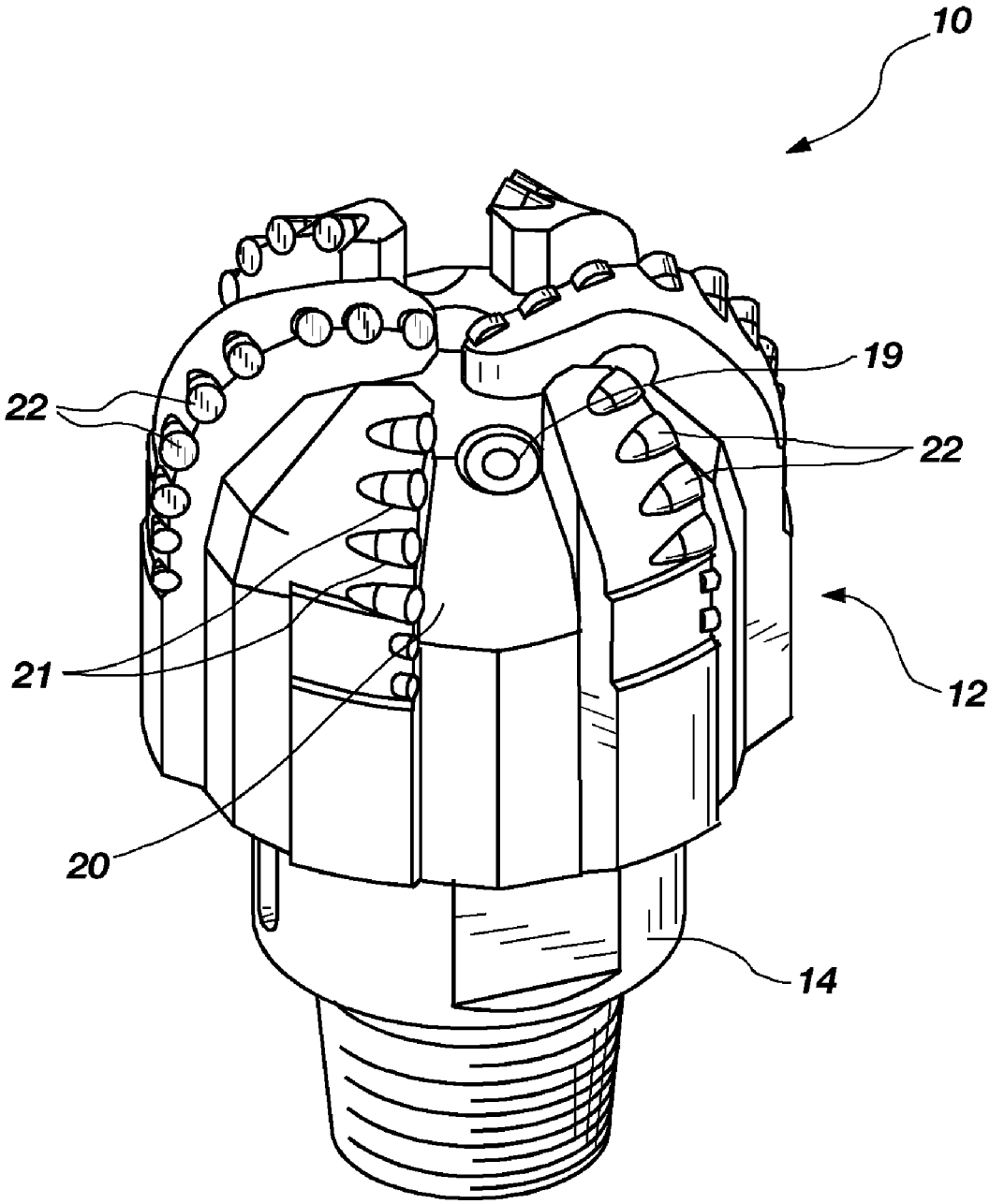
FIG. 1 (PRIOR ART)
FIG. 1 is a perspective view of a rotary drill bit that includes cutting elements.
Figure 2:
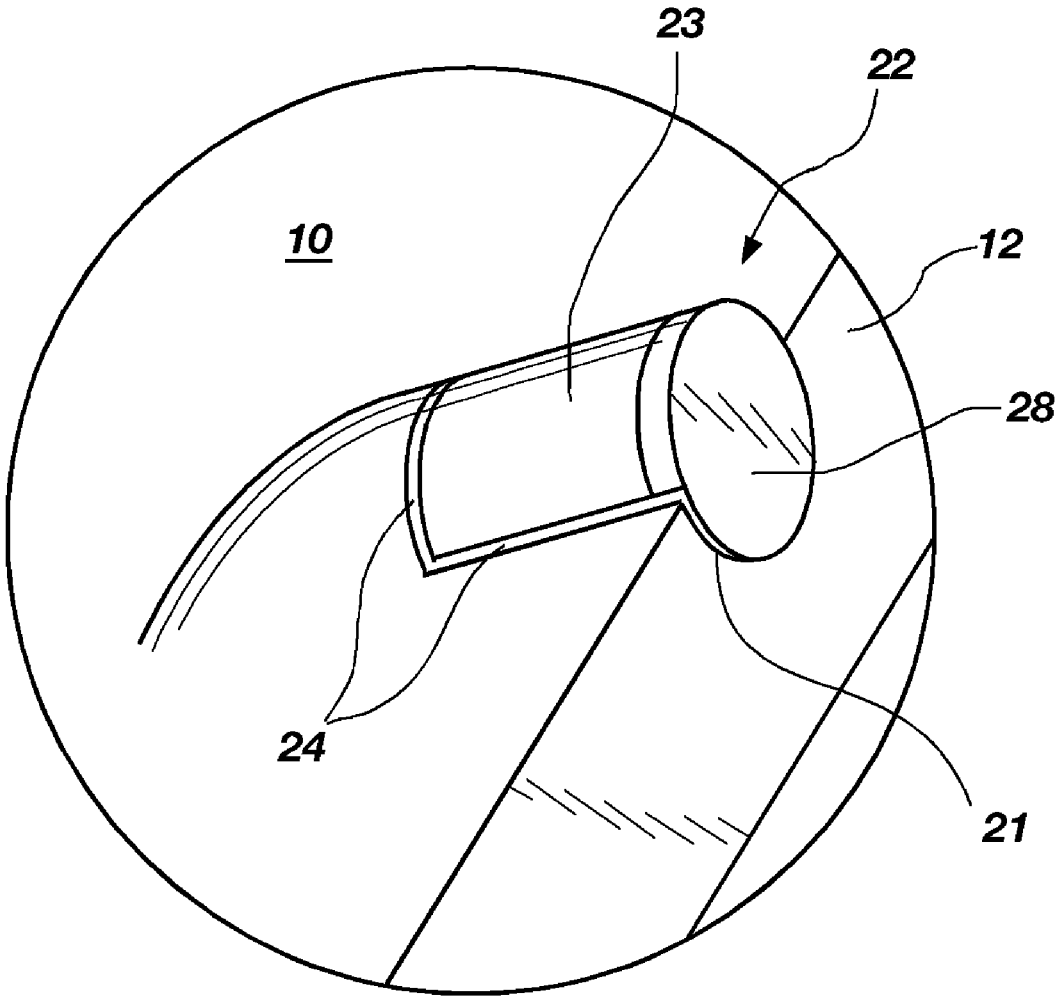
FIG. 2 (PRIOR ART)
FIG. 2 is an enlarged view of a cutting element of the drill bit shown in FIG. 1.
Figure 3:
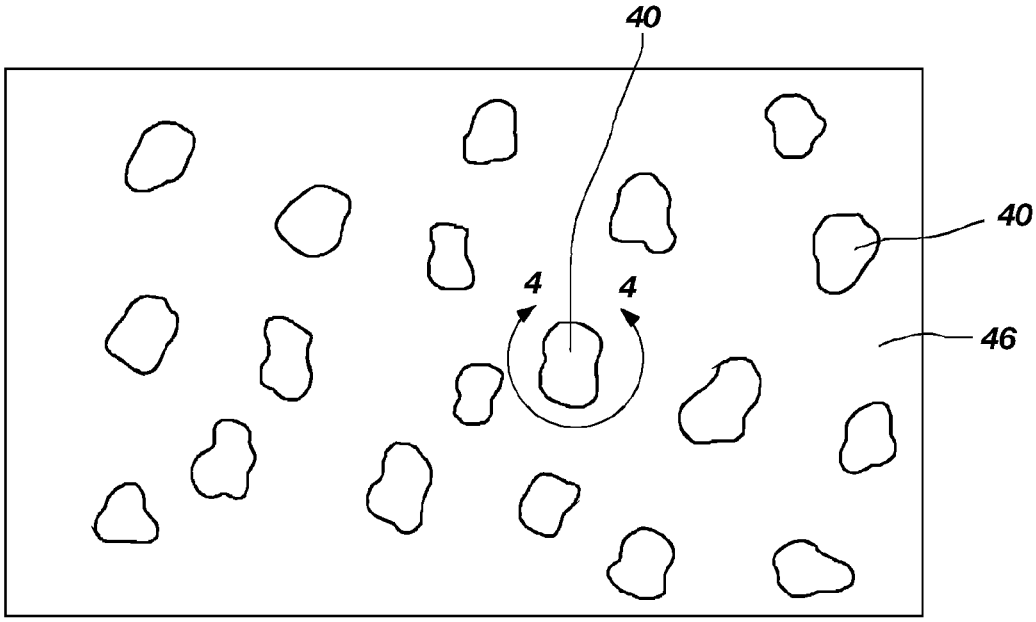
FIG. 3 (PRIOR ART)
FIG. 3 is a representation of a photomicrograph of an abrasive wear-resistant material that includes tungsten carbide particles substantially randomly dispersed throughout a matrix material.
Figure 4:
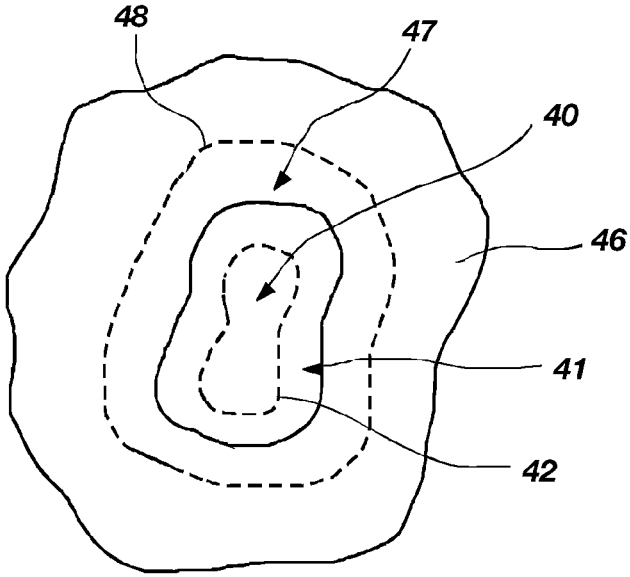
FIG. 4 (PRIOR ART)
FIG. 4 is an enlarged view of a tungsten carbide particle shown in FIG. 3.

The illustrations presented herein are, in some instances, not actual views of any particular drill bit, cutting element, hardfacing material or other feature of a drill bit, but are merely idealized representations which are employed to describe the invention. Additionally, like elements and features among the various drawing figures are identified for convenience with the same or similar reference numerals.

Figure 5:
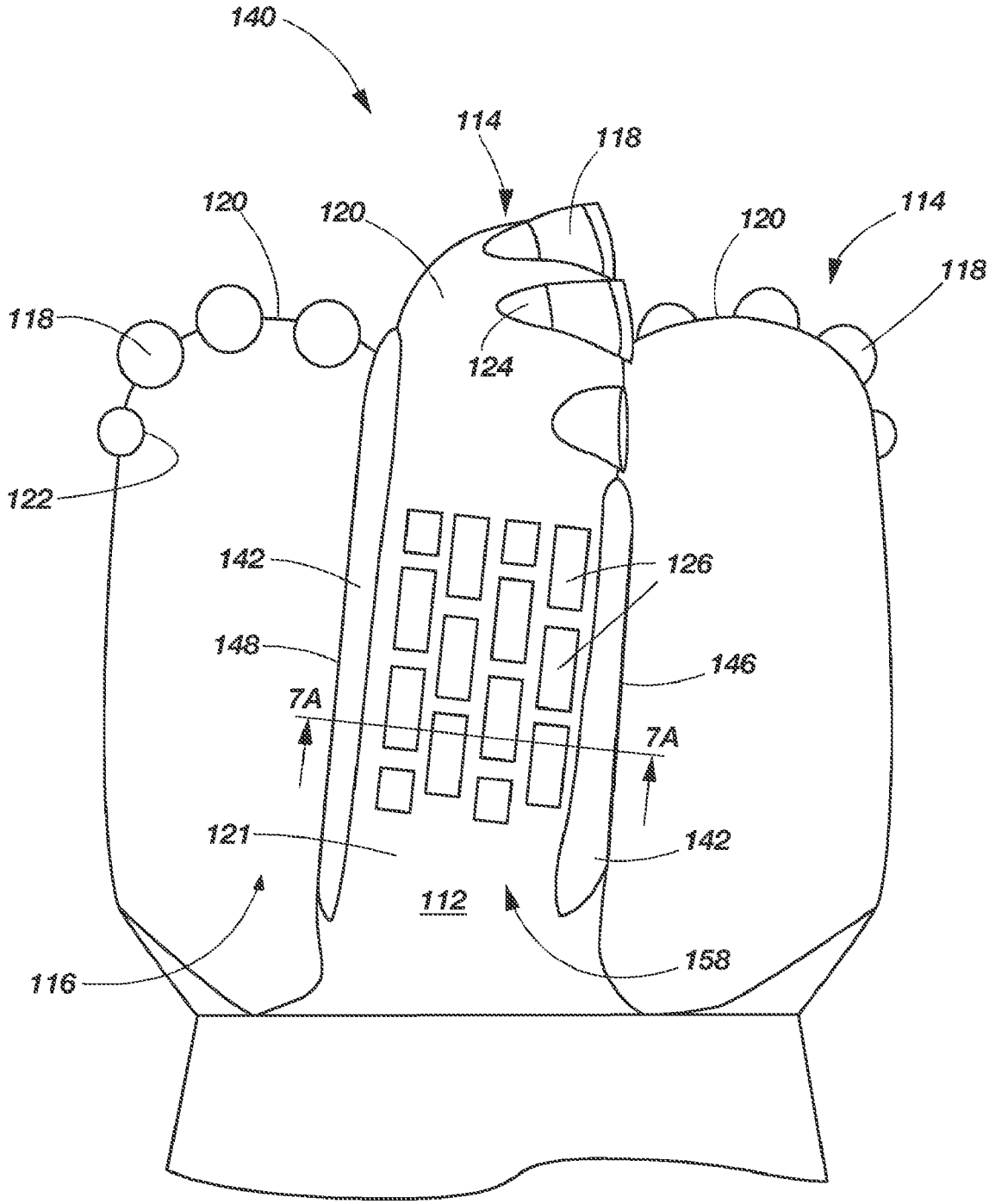
FIG. 5 is a side view of a fixed-cutter rotary drill bit illustrating generally longitudinally extending recesses formed in a blade of the drill bit for receiving abrasive wear-resistant hardfacing material thereon.
Figure 6:
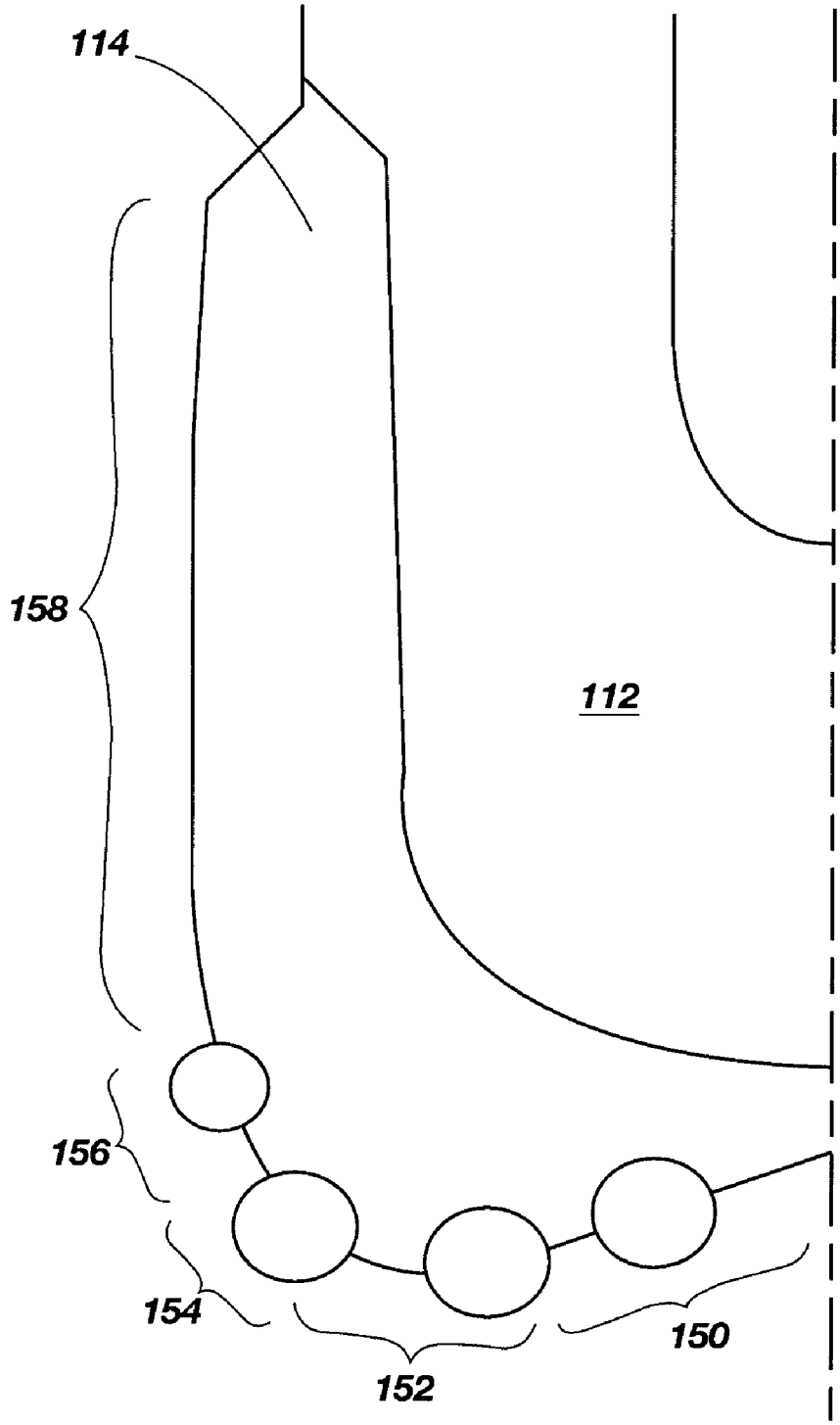
FIG. 6 is a partial side view of one blade of the drill bit shown in FIG. 5 illustrating the various portions thereof.

Embodiments of the invention may be used to enhance the wear resistance of rotary drill bits, particularly rotary drill bits having an abrasive wear-resistant hardfacing material applied to lower stress surface portions thereof. A rotary drill bit 140 in accordance with an embodiment of the invention is shown in FIG. 5. The drill bit 140 includes a bit body 112 that has generally radially projecting and longitudinally extending wings or blades 114, which are separated by junk slots 116. As shown in FIG. 6, each of the blades 114 may include a cone region 150, a nose region 152, a flank region 154, a shoulder region 156, and a gage region 158 (the flank region 154 and the shoulder region 156 may be collectively referred to in the art as either the "flank" or the "shoulder" of the blade). In some embodiments, the blades 114 may not include a cone region 150. Each of these regions includes an outermost surface that is configured to engage the subterranean formation surrounding a well bore hole during drilling. The cone region 150, nose region 152 and flank region 154 are configured and positioned to engage the formation surfaces at the bottom of the well bore hole and to support the majority of the so-called "weight-on-bit" (WOB) applied through the drill string. These regions carry a majority of the cutting elements 118 attached within pockets 122 upon faces 120 of the blades 114 for cutting or scraping away the underlying formation at the bottom of the well bore. The shoulder region 156 is and configured and positioned to bridge the transition between the bottom of the well bore hole and the wall thereof and the gage region 158 is configured and positioned to engage the formation surfaces on the lateral sides of the well bore hole.

As the formation-engaging surfaces of the various regions of the blades 114 slide and scrape against the formation during application of WOB and rotation to drill a formation, the material of the blades 114 at the formation-engaging surfaces thereof has a tendency to wear away. This wearing away of the material of the blades 114 at the formation-engaging surfaces may lead to loss of cutting elements and/or bit instability (e.g., bit whirl), which may further lead to catastrophic failure of the drill bit 140.

In an effort to reduce the wearing away of the material of the blades 114 at the formation-engaging surfaces, various wear-resistant structures and materials have been placed on and/or in these surfaces of the blades 114. For example, inserts such as bricks, studs, and wear knots formed from an abrasive wear-resistant material, such as, for example, tungsten carbide, have been inset in formation-engaging surfaces of blades 114.

As shown in FIG. 5, a plurality of wear-resistant inserts 126 (each of which may comprise, for example, a tungsten carbide brick) may be inset within the blade 114 at the formation-engaging surface 121 of the blade 114 in the gage region 158 thereof. In additional embodiments, the blades 114 may include wear-resistant structures on or in formation-engaging surfaces of other regions of the blades 114, including the cone region 150, nose region 152, flank region 154, and shoulder region 156 as described with respect to FIG. 6. For example, abrasive wear-resistant inserts 126 may be provided on or in the formation-engaging surfaces of the cone region 150 and/or nose region 152 of the blades 114 rotationally behind one or more cutting elements 118.

Abrasive wear-resistant hardfacing material (i.e., hardfacing material) also may be applied at selected locations on the formation-engaging surfaces of the blades 114, particularly the low stress surface portions that are not directly subject to the extreme forces and stresses attendant the cutting surfaces, such as the cutting elements 118. For example, a torch for applying an oxygen-acetylene weld (OAW) or an arc welder, for example, may be used to at least partially melt the wear-resistant hardfacing material to facilitate application of the wear-resistant hardfacing material to the surfaces of the blades 114. Application of the wear-resistant hardfacing material, i.e., hardfacing material, to the bit body 112 is described below.

With continued reference to FIG. 5, recesses 142 for receiving abrasive wear-resistant hardfacing material therein may be formed in the blades 114. By way of example and not limitation, the recesses 142 may extend generally longitudinally along the blades 114, as shown in FIG. 5. A longitudinally extending recess 142 may be formed or otherwise provided along the edge defined by the intersection between the formation-engaging surface 121 and the rotationally leading surface 146 of the blade 114. In addition, a longitudinally extending recess 142 may be formed or otherwise provided along the edge defined by the intersection between the formation-engaging surface 121 and the rotationally trailing surface 148 of the blade 114. One or more of the recesses 142 may extend along the blade 114 adjacent one or more wear-resistant inserts 126. It is recognized that the abrasive wear-resistant hardfacing material may be directly applied to lower stress surface portions of the bit body 112 with or without recesses 142 as illustrated.

Figure 7A:
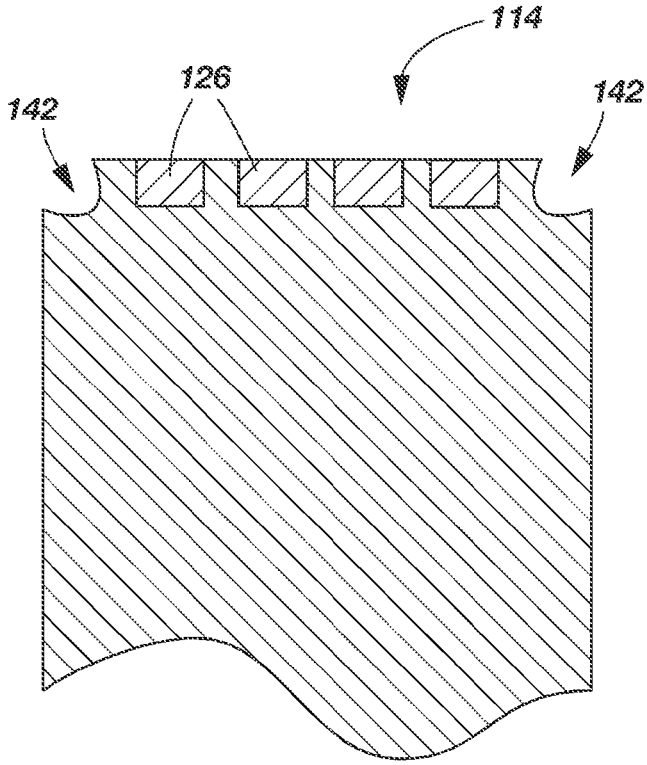
FIG. 7A is a cross-sectional view of a blade of the drill bit illustrated in FIG. 5, taken generally perpendicular to the longitudinal axis of the drill bit, further illustrating the recesses formed in the blade for receiving abrasive wear-resistant hardfacing material therein.

FIG. 7A is a cross-sectional view of the blade 114 shown in FIG. 5 taken along section line 7A-7A shown therein. As shown in FIG. 7A, the recesses 142 may have a generally semicircular cross-sectional shape. The invention is not so limited, however, and in additional embodiments, the recesses 142 may have a cross-sectional shape that is generally triangular, generally rectangular (e.g., square), or any other shape.

The manner in which the recesses 142 are formed or otherwise provided in the blades 114 may depend on the material from which the blades 114 have been formed. For example, if the blades 114 comprise cemented carbide or other particle-matrix composite material, as described below, the recesses 142 may be formed in the blades 114 using, for example, a conventional milling machine or other conventional machining tool (including hand-held machining tools). Optionally, the recesses 142 may be provided in the blades 114 during formation of the blades 114. The invention is not limited by the manner in which the recesses 142 are formed in the blades 114 of the bit body 112 of the drill bit 140, however, and any method that can be used to form the recesses 142 in a particular drill bit 140 may be used to provide drill bits that embody teachings of the invention.

Figure 7B:
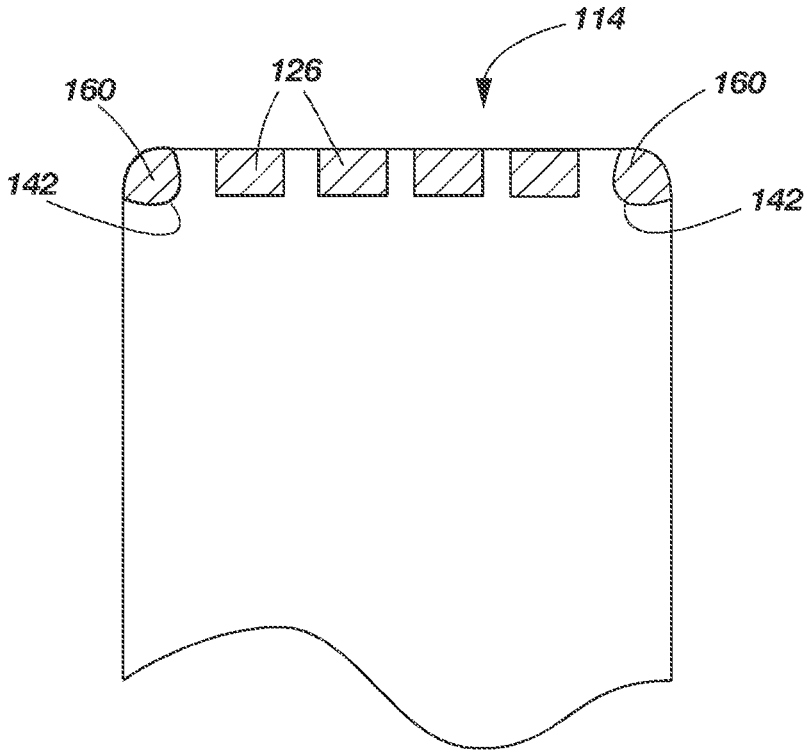
FIG. 7B is a cross-sectional view of the blade of the drill bit illustrated in FIG. 5 similar to that shown in FIG. 7A, and further illustrating abrasive wear-resistant hardfacing material disposed in the recesses previously provided in the blade.

As shown in FIG. 7B, abrasive wear-resistant hardfacing material 160 may be provided in the recesses 142. In some embodiments, the exposed exterior surfaces of the abrasive wear-resistant hardfacing material 160 provided in the recesses 142 may be substantially coextensive with the adjacent exposed exterior surfaces of the blades 114. In other words, the abrasive wear-resistant hardfacing material 160 may not project significantly from the surface of the blades 114. In this configuration, the topography of the exterior surface of the blades 114 after filling the recesses 142 with the abrasive wear-resistant hardfacing material 160 may be substantially similar to the topography of the exterior surface of the blades 114 prior to forming the recesses 142. Stated yet another way, the exposed surfaces of the abrasive wear-resistant hardfacing material 160 may be substantially level, or flush, with the surface of the blade 114 adjacent the wear-resistant hardfacing material 160 in a direction generally perpendicular to the region of the blade 114 adjacent the wear-resistant hardfacing material 160. By substantially maintaining the original topography of the exterior surfaces of the blades 114, forces applied to the exterior surfaces of the blades 114 may be more evenly distributed across the blades 114 in a manner intended by the bit designer. In contrast, when abrasive wear-resistant hardfacing material 160 projects from the exterior surfaces of the blades 114, as the formation engages these projections of abrasive wear-resistant hardfacing material 160, increased localized stresses may develop within the blades 114 in the areas proximate the projections of abrasive wear-resistant hardfacing material 160. The magnitude of these increased localized stresses may be generally proportional to the distance by which the projections extend from the surface of the blades 114 in the direction toward the formation being drilled. Therefore, by configuring the exposed exterior surfaces of the abrasive wear-resistant hardfacing material 160 to substantially match the exposed exterior surfaces of the blades 114 removed when forming the recesses 142, these increased localized stresses may be reduced or eliminated, which may also facilitate decreased wear and increased service life of the drill bit 140.

It is recognized in other embodiments of the invention, hardfacing material may optionally be applied directly to the face 120 of the bit body 112 without creating recesses 142 while still enhancing the wear-resistance of the surfaces of the bit body.

Figure 8:
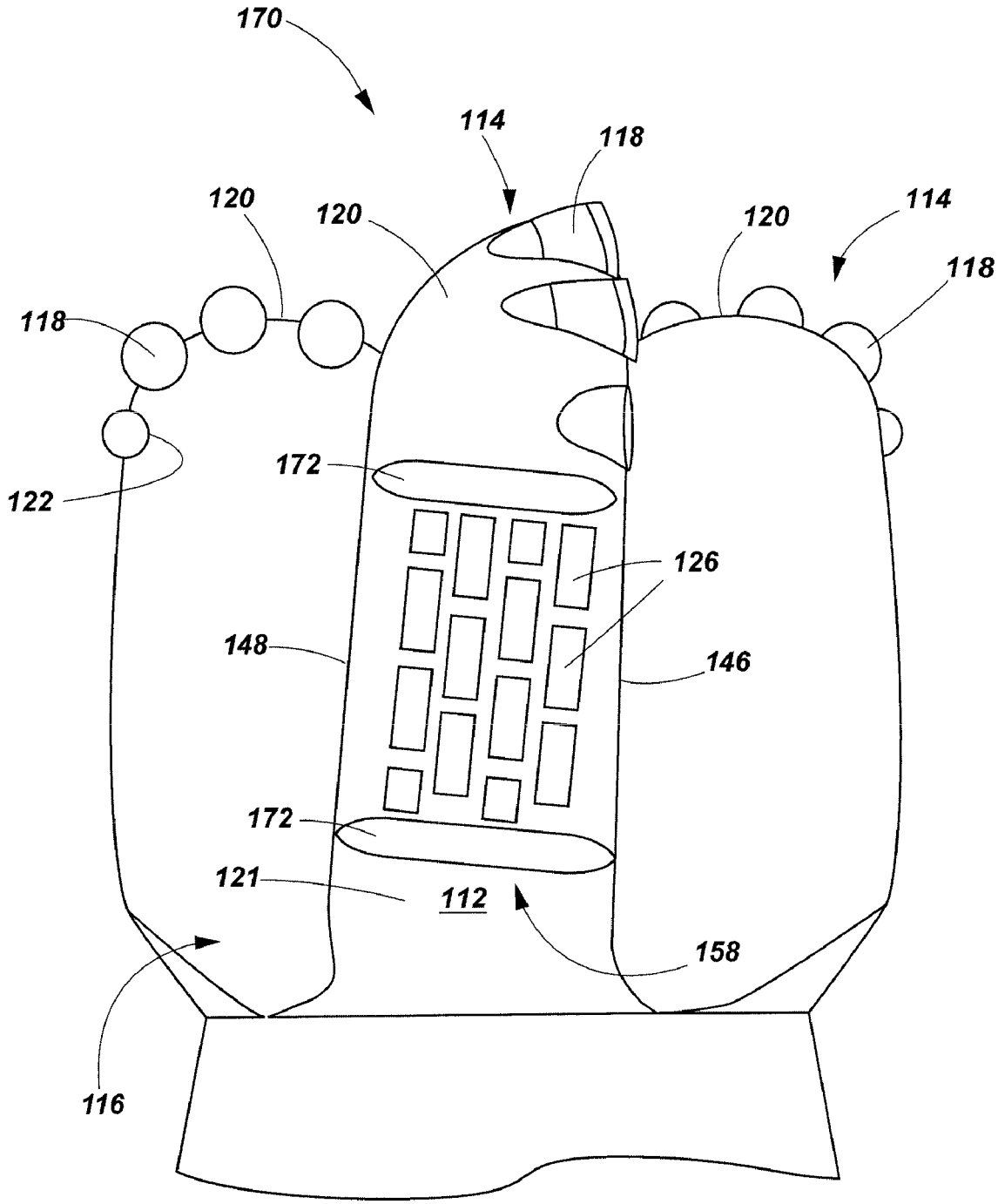
FIG. 8 is a side view of another fixed-cutter rotary drill bit, similar to that shown in FIG. 5, illustrating generally circumferentially extending recesses formed in a blade of the drill bit for receiving abrasive wear-resistant hardfacing material therein.

FIG. 8 illustrates another rotary drill bit 170 according to an embodiment of the invention. The drill bit 170 is generally similar to the drill bit 140 previously described with reference to FIG. 5, and includes a plurality of blades 114 separated by junk slots 116. A plurality of wear-resistant inserts 126 are inset within the formation-engaging surface 121 of each blade 114 in the gage region 158 of the bit body 112. The drill bit 170 further includes a plurality of recesses 172 formed adjacent the region of each blade 114 comprising the plurality of wear-resistant inserts 126. The recesses 172 may be generally similar to the recesses 142 previously described herein in relation to FIGS. 5, 6, 7A and 7B. The recesses 172 within the face 120 of the bit, however, extend generally circumferentially around the drill bit 170 in a direction generally parallel to the direction of rotation of the drill bit 170 during drilling.

Figure 9:
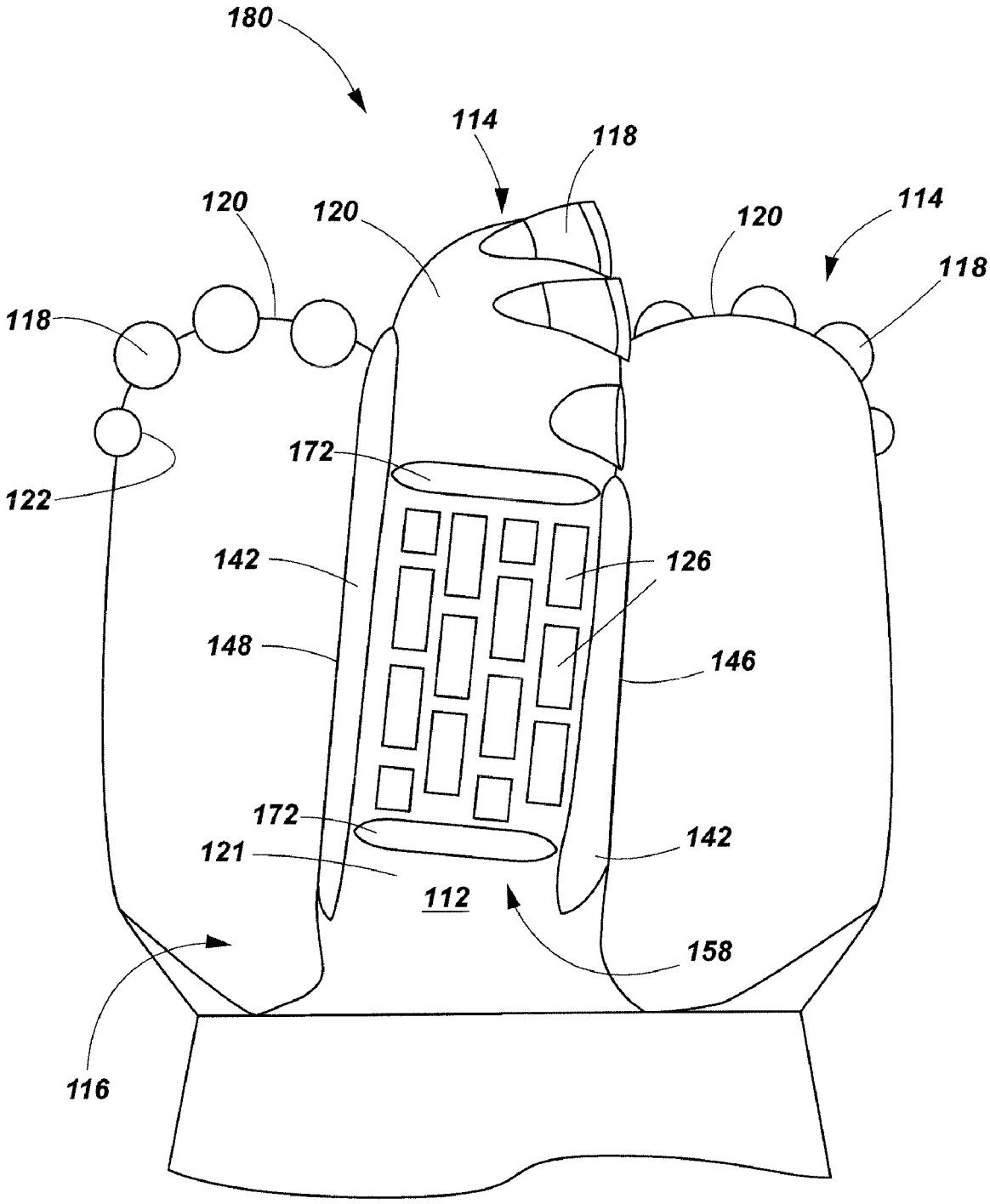
FIG. 9 is a side view of yet another fixed-cutter rotary drill bit, similar to those shown in FIGS. 5 and 8, illustrating both generally longitudinally extending recesses and generally circumferentially extending recesses formed in a blade of the drill bit for receiving abrasive wear-resistant hardfacing material therein.

FIG. 9 illustrates yet another drill bit 180 that embodies teachings of the invention. The drill bit 180 is generally similar to the drill bit 140 and the drill bit 170 (see FIGS. 5 and 8) and includes a plurality of blades 114, junk slots 116, and wear-resistant inserts 126 inset within the formation-engaging surface 121 of each blade 114 in the gage region 158 thereof. The drill bit 180, however, includes both generally longitudinally extending recesses 142 like those of the drill bit 140 and generally circumferentially extending recesses 172 like those of the drill bit 170. In this configuration, each plurality of wear-resistant inserts 126 may be substantially peripherally surrounded by recesses 142, 172 that are filled with abrasive wear-resistant hardfacing material 160 (FIG. 7B) generally up to the exposed exterior surface of the blades 114. By substantially surrounding the periphery of each region of the blade 114 comprising a plurality of wear-resistant inserts 126, wearing away of the material in the lower stress portions of the blade 114 adjacent the higher stress portion of the plurality of wear-resistant inserts 126 may be reduced or eliminated, which may prevent loss of one or more of the wear-resistant inserts 126 during drilling.

In the embodiment shown in FIG. 9, the regions of the blades 114 comprising a plurality of wear-resistant inserts 126 are substantially peripherally surrounded by recesses 142, 172 that may be filled with abrasive wear-resistant hardfacing material 160 (FIG. 7B). In additional embodiments, one or more wear-resistant inserts of a drill bit may be individually substantially peripherally surrounded by recesses filled with abrasive wear-resistant hardfacing material.

Figure 10:
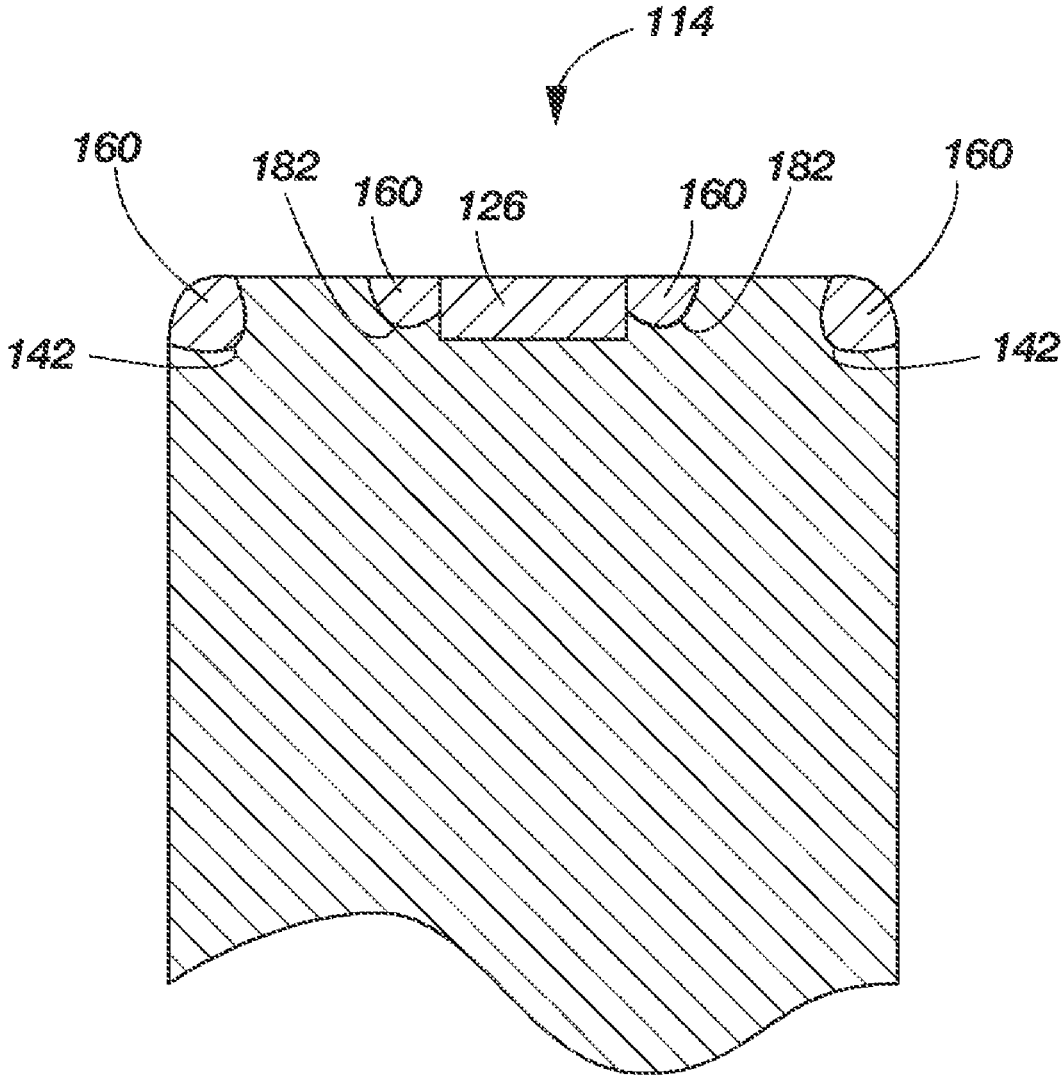
FIG. 10 is a cross-sectional view, similar to those shown in FIGS. 7A and 7B, illustrating recesses formed generally around a periphery of a wear-resistant insert provided in a formation-engaging surface of a blade of a rotary drill bit for receiving abrasive wear-resistant hardfacing material therein.

FIG. 10 is a cross-sectional view of a blade 114 of another drill bit according to an embodiment of the invention. The cross-sectional view is similar to the cross-sectional views shown in FIGS. 7A and 7B. The blade 114 shown in FIG. 10, however, includes a wear-resistant insert 126 that is individually substantially peripherally surrounded by recesses 182 that are filled with abrasive wear-resistant hardfacing material 160. The recesses 182 may be substantially similar to the previously described recesses 142, 172 and may be filled with abrasive wear-resistant hardfacing material 160. In this configuration, the exposed exterior surfaces of the wear-resistant insert 126, abrasive wear-resistant hardfacing material 160, and regions of the blade 114 adjacent the abrasive wear-resistant hardfacing material 160 may be generally coextensive and planar to reduce or eliminate localized stress concentration caused by any abrasive wear-resistant hardfacing material 160 projecting from the blade 114 generally toward a formation being drilled.

Figure 11:
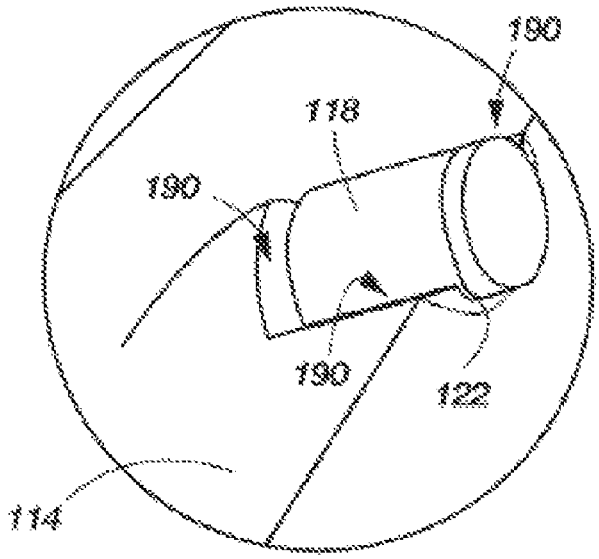
FIG. 11 is a perspective view of a cutting element secured to a blade of a rotary drill bit and illustrating recesses formed generally around a periphery of the cutting element for receiving abrasive wear-resistant hardfacing material therein.
Figure 12:
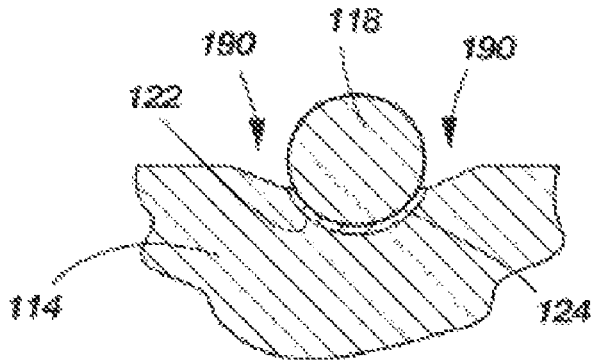
FIG. 12 is a cross-sectional view of a portion of the cutting element and blade shown in FIG. 11, taken generally perpendicular to the longitudinal axis of the cutting element, further illustrating the recesses formed generally around the periphery of the cutting element.
Figure 13:
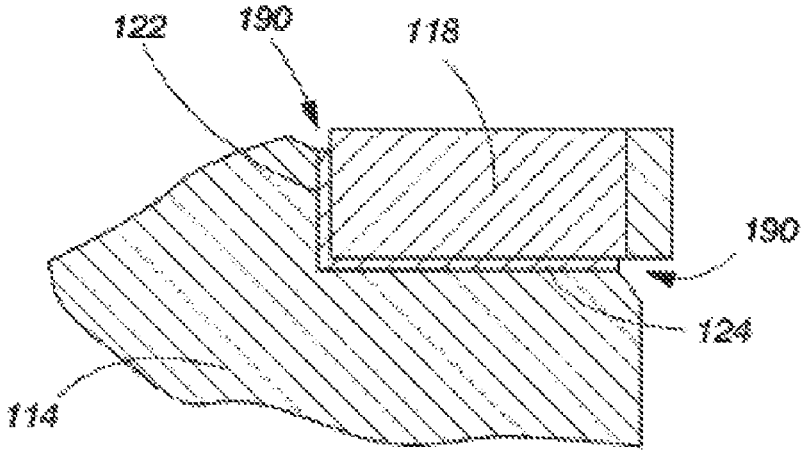
FIG. 13 is another cross-sectional view of a portion of the cutting element and blade shown in FIG. 11, taken generally parallel to the longitudinal axis of the cutting element, further illustrating the recesses formed generally around the periphery of the cutting element.

In additional embodiments, recesses for receiving the abrasive wear-resistant hardfacing material may be provided around cutting elements. FIG. 11 is a perspective view of one cutting element 118 secured within a cutter pocket 122 on a blade 114 of a drill bit similar to each of the previously described drill bits. As shown in each of FIGS. 11-13, recesses 190 may be formed in the blade 114 that substantially peripherally surround the cutting element 118. As shown in FIGS. 12 and 13, the recesses 190 may have a cross-sectional shape that is generally triangular, although, in additional embodiments, the recesses 190 may have any other shape. The cutting element 118 may be secured within the cutter pocket 122 using a bonding material 124 such as, for example, an adhesive or brazing alloy may be provided at the interface and used to secure and attach the cutting element 118 to the blade 114.

Figure 14:
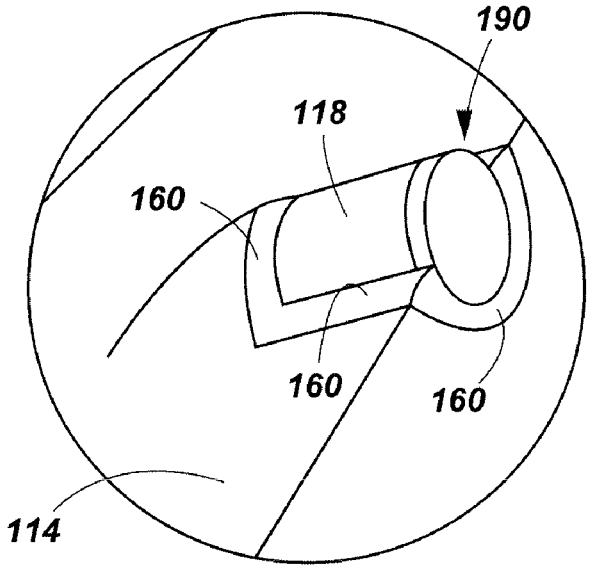
FIG. 14 is a perspective view of the cutting element and blade shown in FIG. 11 and further illustrating abrasive wear-resistant hardfacing material disposed in the recesses provided around the periphery of the cutting element.
Figure 15:
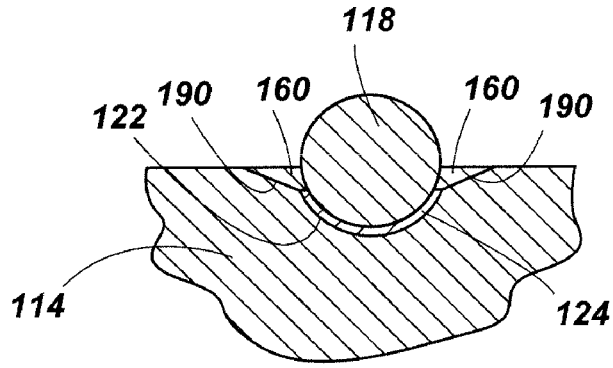
FIG. 15 is a cross-sectional view of the cutting element and blade like that shown in FIG. 12 and further illustrating the abrasive wear-resistant hardfacing material provided in the recesses around the periphery of the cutting element.
Figure 16:
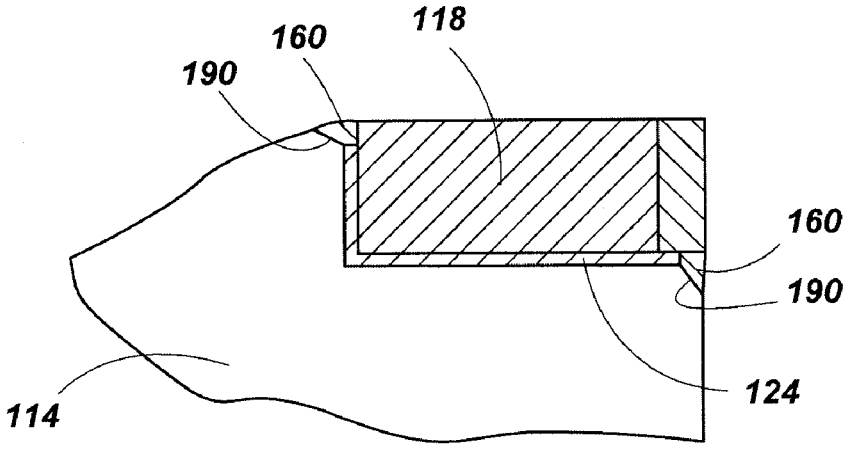
FIG. 16 is a cross-sectional view of the cutting element and blade like that shown in FIG. 13 and further illustrating the abrasive wear-resistant hardfacing material provided in the recesses formed around the periphery of the cutting element.

FIGS. 14-16 are substantially similar to FIGS. 11-13, respectively, but further illustrate abrasive wear-resistant hardfacing material 160 disposed within the recesses 190 provided around the cutting element 118. The exposed exterior surfaces of the abrasive wear-resistant hardfacing material 160 and the regions of the blade 114 adjacent the abrasive wear-resistant hardfacing material 160 may be generally coextensive. Furthermore, abrasive wear-resistant hardfacing material 160 may be configured so as not to extend beyond the adjacent surfaces of the blade 114 to reduce or eliminate localized stress concentration caused by any abrasive wear-resistant hardfacing material 160 projecting from the blade 114 generally toward a formation being drilled.

Additionally, in this configuration, the abrasive wear-resistant hardfacing material 160 may cover and protect at least a portion of the bonding material 124 used to secure the cutting element 118 within the cutter pocket 122, which may protect the bonding material 124 from wear during drilling. By protecting the bonding material 124 from wear during drilling, the abrasive wear-resistant hardfacing material 160 may help to prevent separation of the cutting element 118 from the blade 114, damage to the bit body, and catastrophic failure of the drill bit.

Furthermore, it is to be recognized that the cutting element 118 is illustratively shown with the abrasive wear-resistant hardfacing material 160 disposed in the recesses 190 about cutting element 118. For materials of the cutting element 118 that are more sensitive to temperature excursion and higher temperature, the abrasive wear-resistant hardfacing material 160 may be applied to the recesses 190 prior to bonding the cutting element 118 into the cutter pocket 122, which may potentially requiring grinding, for example, of the abrasive wear-resistant hardfacing material 160 in order to prep the cutter pocket 122 for locatably receiving the cutting element 118 therein. Also, the abrasive wear-resistant hardfacing material 160 may be applied to the recesses 190 during or subsequent to bonding the cutting element 118 into the cutter pocket 122. For example, applying the abrasive wear-resistant hardfacing material 160 in the recesses 190 disposed about the cutting element 118 may be accomplished without damage thereto, when the cutting table, i.e., polycrystalline diamond compact table, of the cutting element 118 is either less affected by temperature transitions during application than the abrasive wear-resistant hardfacing material 160 or the cutting table is disposed forward of the recesses 190 so as to not be directly disposed to the abrasive wear-resistant hardfacing material 160 during application into the recess 190.

Figure 17:
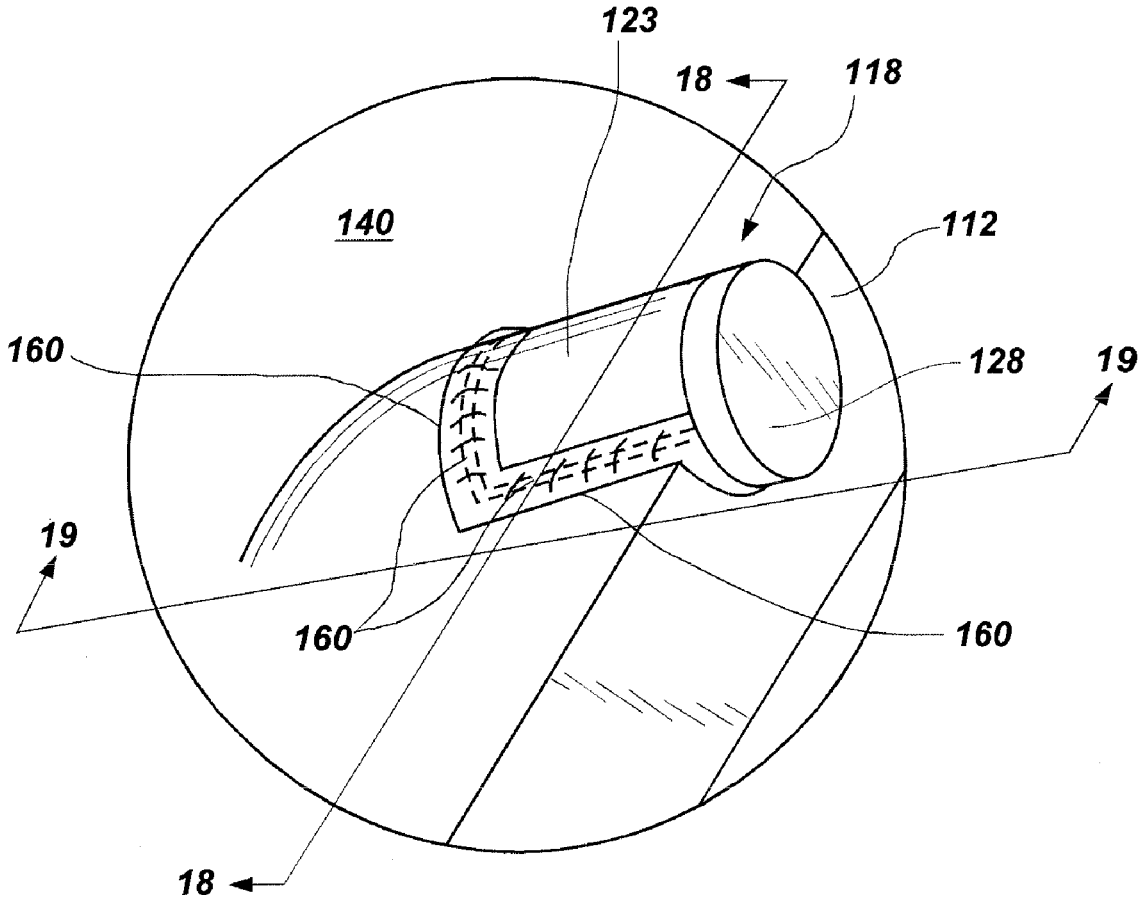
FIG. 17 is a perspective view of a cutting element and blade like that shown in FIG. 16 and further embodies teachings of the invention.
Figure 18:
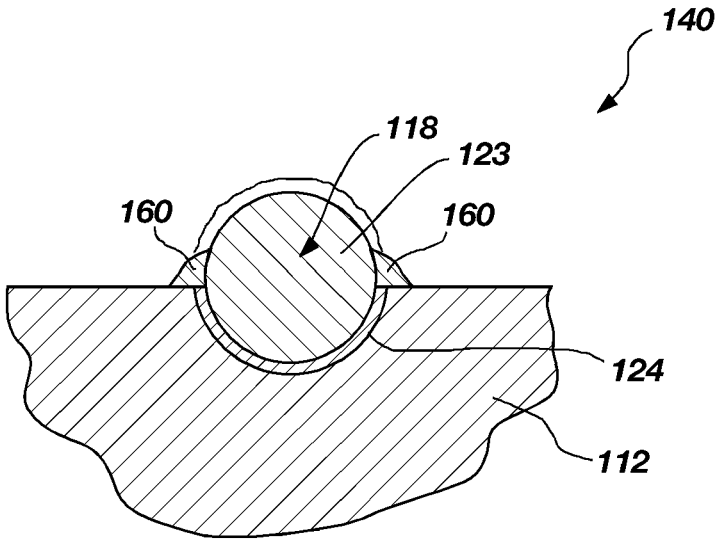
FIG. 18 is a lateral cross sectional view of the cutting element shown in FIG. 17 taken along section line 18-18 therein.
Figure 19:
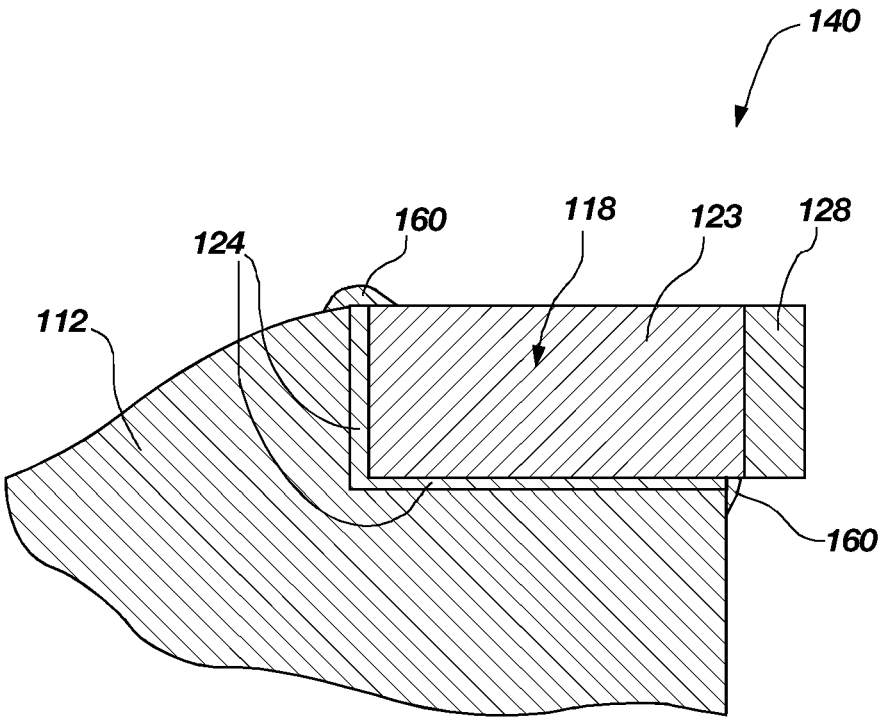
FIG. 19 is a longitudinal cross sectional view of the cutting element shown in FIG. 17 taken along section line 19-19 therein.

FIGS. 17-19 are substantially similar to FIGS. 11-13, respectively, but further illustrate abrasive wear-resistant hardfacing material 160 disposed upon the bonding material 124 securing the cutting element 118 to the rotary drill bit 140. The rotary drill bit 140 is structurally similar to the rotary drill bit 10 shown in FIG. 1, and includes a plurality of cutting elements 118 positioned and secured within pockets provided on the outer surface of a bit body 112. As illustrated in FIG. 17, each cutting element 118 may be secured to the bit body 112 of the drill bit 140 along an interface therebetween. A bonding material 124 such as, for example, an adhesive or brazing alloy may be provided at the interface and used to secure and attach each cutting element 118 to the bit body 112. The bonding material 124 may be less resistant to wear than the materials of the bit body 112 and the cutting elements 118. Each cutting element 118 may include a polycrystalline diamond compact table 128 attached and secured to a cutting element body or substrate 123 along an interface.

The rotary drill bit 140 further includes an abrasive wear-resistant material 160 disposed on a surface of the drill bit 140. Moreover, regions of the abrasive wear-resistant material 160 may be configured to protect exposed surfaces of the bonding material 124.

FIG. 18 is a lateral cross sectional view of the cutting element 118 shown in FIG. 17 taken along section line 18-18 therein. As illustrated in FIG. 18, continuous portions of the abrasive wear-resistant material 160 may be bonded both to a region of the outer surface of the bit body 112 and a lateral surface of the substrate 123 of the cutting element 118 and each continuous portion may extend over at least a portion of the interface between the bit body 112 and the lateral sides of the substrate 123 of the cutting element 118.

FIG. 19 is a longitudinal cross sectional view of the cutting element 118 shown in FIG. 17 taken along section line 19-19 therein. As illustrated in FIG. 19, another continuous portion of the abrasive wear-resistant material 160 may be bonded both to a region of the outer surface of the bit body 112 and a lateral surface of the substrate 123 of cutting element 118 and may extend over at least a portion of the interface between the bit body 112 and the longitudinal end surface of the cutting element 118 opposite the a polycrystalline diamond compact table 128. Applying the abrasive wear-resistant material 160 over the region of the outer surface of the bit body 112 and a lateral surface of the substrate 123 of cutting element 118 provides abrasion and wear protection for the bonding material 124. Further, the substrate 123 may adequately dissipate and withstand heat generated during application of the abrasive wear-resistant material 160 thereto, allowing the polycrystalline diamond compact table 128 to be protected from heat-induced fracture and graphitization.

In this configuration, the continuous portions of the abrasive wear-resistant material 160 may cover and protect at least a portion of the bonding material 124 disposed between the cutting element 118 and the bit body 112 from wear during drilling operations. By protecting the bonding material 124 from wear during drilling operations, the abrasive wear-resistant material 160 helps to prevent separation of the cutting element 118 from the bit body 112 during drilling operations, damage to the bit body 112, and catastrophic failure of the rotary drill bit 140.

Figure 20:
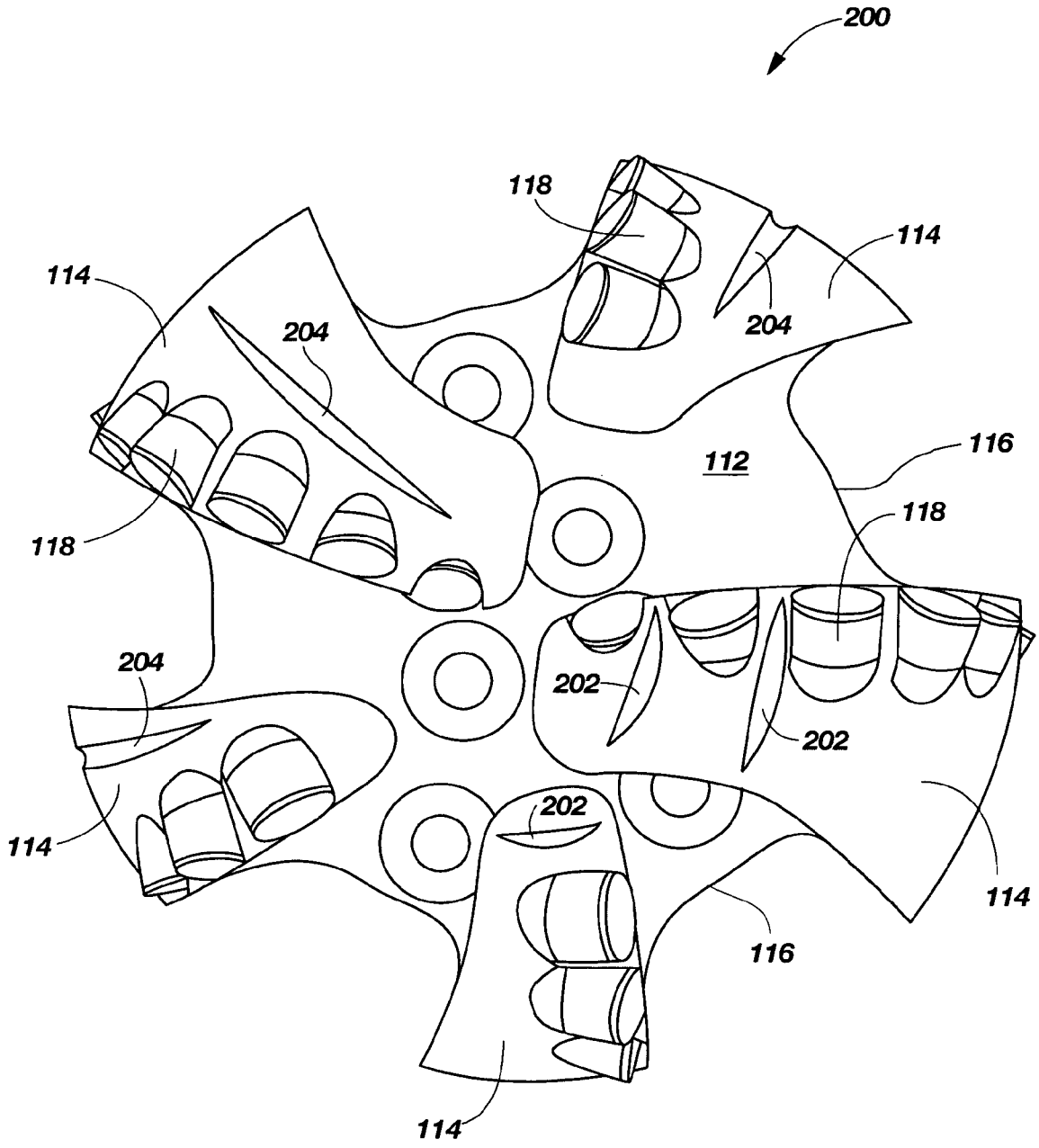
FIG. 20 is an end view of yet another fixed-cutter rotary drill bit illustrating generally recesses formed in nose and cone regions of blades of the drill bit for receiving abrasive wear-resistant hardfacing material therein.

The continuous portions of the abrasive wear-resistant material 160 that cover and protect exposed surfaces of the bonding material 124 may be configured as a bead or beads of abrasive wear-resistant material 160 provided along and over the edges of the interfacing surfaces of the bit body 112 and the cutting element 118. The abrasive wear-resistant material 160 provides an effective method for enhancing the wear-resistance of the bonding material 124 to help prevent the loss of cutting elements 118 during drilling operations FIG. 20 is an end view of yet another rotary drill bit 200 according to an embodiment of the invention. As shown in FIG. 20, in some embodiments of the invention, recesses 202 may be provided between cutting elements 118. For example, the recesses 202 may extend generally circumferentially about a longitudinal axis of the rotary drill bit 200 (not shown) between cutting elements 118 positioned in the cone region 150 (FIG. 6) and/or the nose region 152 (FIG. 6). Furthermore, as shown in FIG. 20, in some embodiments of the invention, recesses 204 may be provided rotationally behind cutting elements 118. For example, the recesses 204 may extend generally longitudinally along a blade 114 rotationally behind one or more cutting elements 118 positioned in the cone region 150 (FIG. 6) and/or the nose region 152 (FIG. 6). In additional embodiments, the recesses 204 may not be elongated and may have a generally circular or a generally rectangular shape. Such recesses 204 may be positioned directly rotationally behind one or more cutting elements 118, or rotationally behind adjacent cutting elements 118, but at a radial position (measured from the longitudinal axis of the drill bit 200) between the adjacent cutting elements 118. The abrasive wear-resistant material 160 may be applied in the recesses 202, 204 or may be applied upon other surfaces exposed to lower stresses of the rotary drill bit 200 in order to help reduce erosion and wear, particularly from the particulate entrained slurry.

The abrasive wear-resistant hardfacing materials described herein may comprise, for example, a ceramic-metal composite material (i.e., a "cermet" material) comprising a plurality of hard ceramic phase regions or particles dispersed throughout a metal matrix material. The hard ceramic phase regions or particles may comprise carbides, nitrides, oxides, and borides (including boron carbide ($B_4C$)). More specifically, the hard ceramic phase regions or particles may comprise carbides and borides made from elements such as W, Ti, Mo, Nb, V, Hf, Ta, Cr, Zr, Al, and Si. By way of example and not limitation, materials that may be used to form hard ceramic phase regions or particles include tungsten carbide, titanium carbide (TiC), tantalum carbide (TaC), titanium diboride ($TiB_2$), chromium carbides, titanium nitride (TiN), aluminum oxide ($Al_2O_3$), aluminum nitride (AlN), and silicon carbide (SiC). The metal matrix material of the ceramic-metal composite material may include, for example, cobalt-based, iron-based, nickel-based, iron and nickel-based, cobalt and nickel-based, iron and cobalt-based, aluminum-based, copper-based, magnesium-based, and titanium-based alloys. The matrix material may also be selected from commercially pure elements such as cobalt, aluminum, copper, magnesium, titanium, iron, and nickel.

In embodiments of the invention, the abrasive wear-resistant hardfacing materials may be applied to a bit body or tool body and include materials as described below. As used herein, the term "bit" includes not only conventional drill bits, but also core bits, bi-center bits, eccentric bits, tri-cone bits and tools employed in drilling of a well bore.

Figure 21:
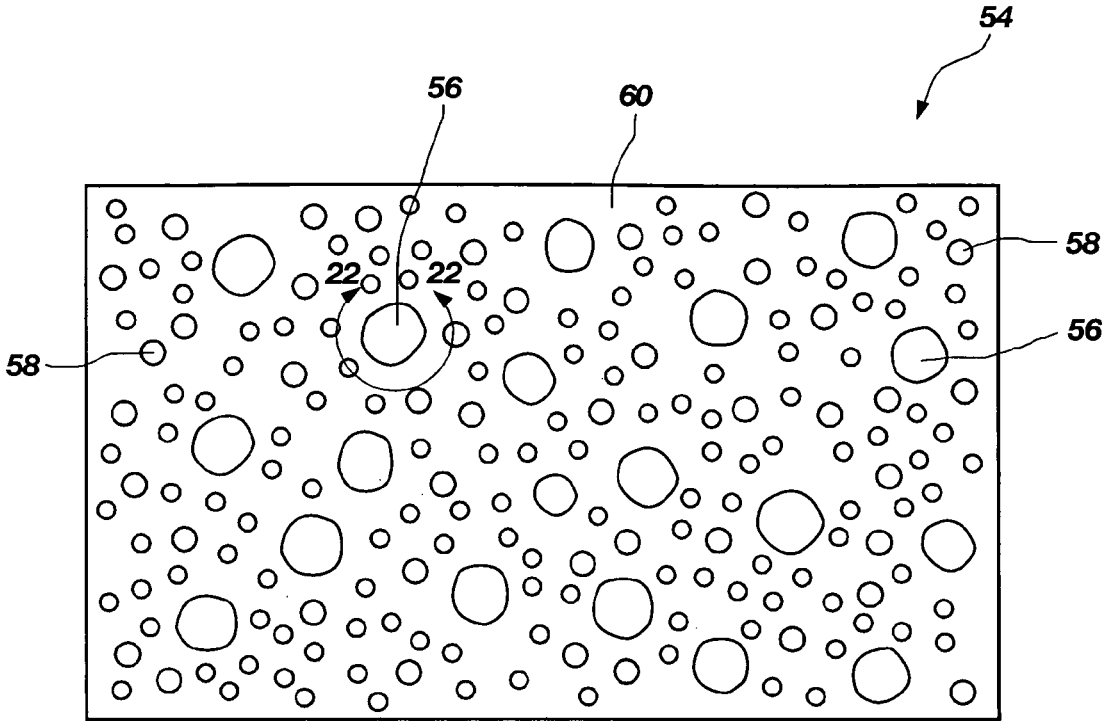
FIG. 21 is a representation of a photomicrograph of an abrasive wear-resistant material that embodies teachings of the invention and that includes dense sintered carbide pellets and carbide particles substantially randomly dispersed throughout a matrix.
Figure 23A:
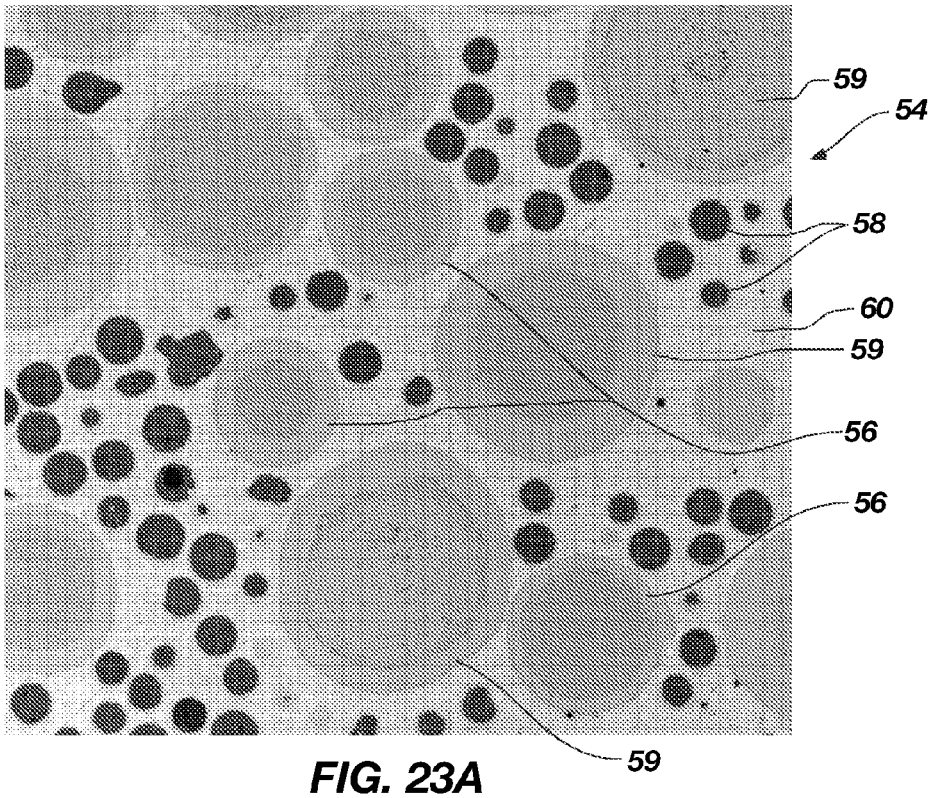
FIGS. 23A and 23B show photomicrographs of an abrasive wear-resistant hardfacing material that embodies teachings of the invention and that includes dense sintered carbide particles substantially randomly dispersed throughout a matrix.
Figure 23B:
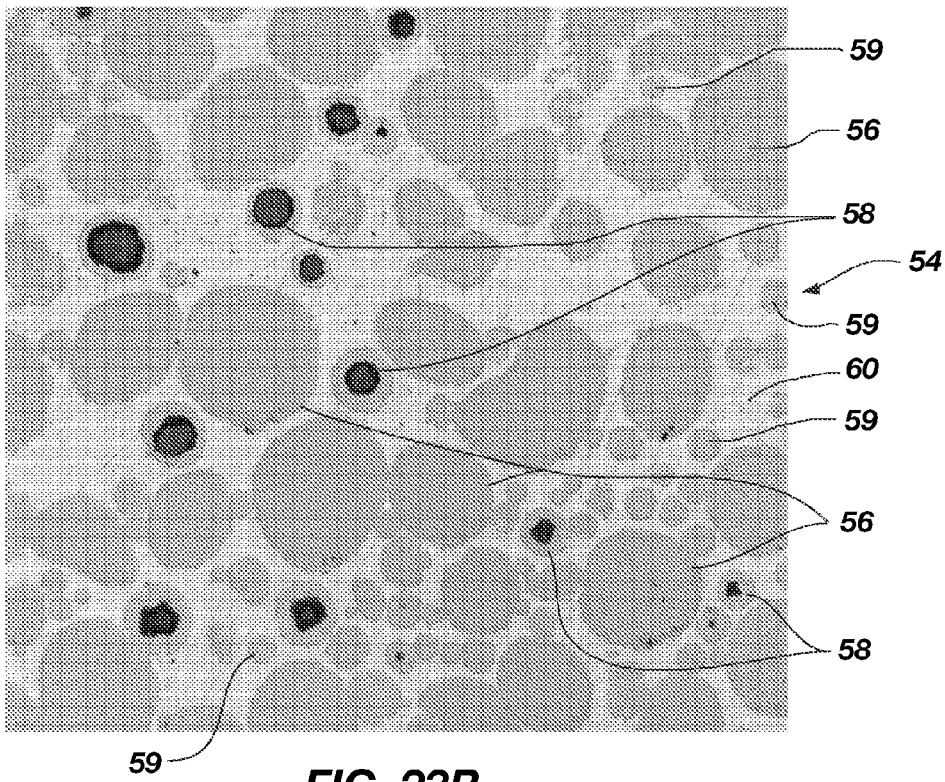

FIG. 21 represents a polished and etched surface of an abrasive wear-resistant material 54 according to an embodiment of the invention, particularly suitable for applying the material as a "hardfacing" upon a drill bit having a particle-matrix composite material. FIGS. 23A and 23B are actual photomicrographs of a polished and etched surface of an abrasive wear-resistant material according to embodiments of the invention. Referring to FIG. 21, the abrasive wear-resistant material 54 includes a plurality of dense sintered carbide pellets 56 and a plurality of carbide granules 58 substantially randomly dispersed throughout a matrix material 60. Each dense sintered carbide pellet 56 may have a generally spherical pellet configuration. The term "pellet" as used herein means any particle having a generally spherical shape. Pellets are not true spheres, but lack the corners, sharp edges, and angular projections commonly found in crushed and other non-spherical tungsten carbide particles. The term "dense sintered carbide pellets," also known as "super dense particles," as used herein includes the class of sintered pellets as disclosed in U.S. Patent Publication No. 2003/0000339, the entire disclosure of which is incorporated by reference herein. The dense sintered carbide pellets are of substantially spheroidal shape and have a predominantly closed porosity or are free of pores. The process for producing such pellets starts from a powder material with a partially porous internal structure, which is introduced into a furnace and sintered at a temperature at which the material of the metallic binder adopts a pasty state while applying pressure to reduce the pore content of the starting material to obtain a final density.

The plurality of dense sintered carbide pellets 56 in this embodiment of the invention are a tungsten carbide material, but may include other materials as indicated herein. The plurality of carbide granules 58 may include tungsten carbide or other materials as indicated herein. The plurality of carbide granules 58 may be or include cast carbide pellets, crushed cast carbide, spherical cast carbide and spherical sintered carbide, and may further include pluralities thereof. The plurality of carbide granules 58 may also include macrocrystalline carbide.

In at least one embodiment of the invention, the abrasive wear-resistant material 54 may include a plurality of dense sintered carbide pellets 56 substantially randomly dispersed throughout a matrix material 60 with or without the tungsten carbide granules 58 as illustrated in FIG. 21.

In some embodiments of the invention, the abrasive wear-resistant material 54 may include a plurality of dense sintered tungsten carbide pellets 56, a plurality of sintered tungsten carbide granules 58, and a plurality of spherical cast tungsten carbide pellets 59 substantially randomly disposed through a matrix material 60. The matrix material 60 comprising a nickel-based alloy material, as shown in FIG. 23A.

In still other embodiments of the invention, the abrasive wear-resistant material 54 may include a plurality of dense sintered tungsten carbide pellets 56, a plurality of crushed cast tungsten carbide granules 58, and a plurality of spherical cast tungsten carbide pellets 59 substantially randomly disposed through a matrix material 60. The matrix material 60 may comprise an iron-based alloy material, as shown in FIG. 23B.

Corners, sharp edges, and angular projections may produce residual stresses, which may cause tungsten carbide material in the regions of the particles proximate the residual stresses to melt at lower temperatures during application of the abrasive wear-resistant material 54 to a surface of a drill bit. Melting or partial melting of the tungsten carbide material during application may facilitate dissolution between the tungsten carbide particles and the surrounding matrix material. As previously discussed herein, dissolution between the matrix material 60 and the dense sintered carbide pellets 56 and carbide granules 58 may embrittle the matrix material 60 in regions surrounding the tungsten carbide pellets 56 and carbide granules 58 and may reduce the toughness of the hardfacing material, particularly when the matrix material is iron-based, as illustrated in FIG. 23B. Such dissolution may degrade the overall physical properties of the abrasive wear-resistant material 54. The use of dense sintered carbide pellets 56 (and, optionally, carbide granules 58 and carbide pellets 59) instead of conventional tungsten carbide particles that include corners, sharp edges, and angular projections may reduce such dissolution, preserving the physical properties of the matrix material 60 and the dense sintered carbide pellets 56 (and, optionally, the carbide granules 58) during application of the abrasive wear-resistant material 54 to the surfaces of drill bits and other tools.

The matrix material 60 may comprise between about 20% and about 75% by weight of the abrasive wear-resistant material 54. More particularly, the matrix material 60 may comprise between about 55% and about 70% by weight of the abrasive wear-resistant material 54. The plurality of dense sintered carbide pellets 56 may comprise between about 25% and about 70% by weight of the abrasive wear-resistant material 54. More particularly, the plurality of dense sintered carbide pellets 56 may comprise between about 10% and about 45% by weight of the abrasive wear-resistant material 54. Furthermore, the plurality of carbide granules 58 may comprise less than about 35% by weight of the abrasive wear-resistant material 54. For example, the matrix material 60 may be about 60% by weight of the abrasive wear-resistant material 54, the plurality of dense sintered carbide pellets 56 may be about 30% by weight of the abrasive wear-resistant material 54, and the plurality of carbide granules 58 may be about 10% by weight of the abrasive wear-resistant material 54. As another example, the matrix material 60 may be about 65% by weight of the abrasive wear-resistant material 54, and the plurality of dense sintered carbide pellets 56 may be about 35% by weight of the abrasive wear-resistant material 54.

The dense sintered carbide pellets 56 may include −40/+80 ASTM mesh pellets. As used herein, the phrase "−40/+80 ASTM mesh pellets" means pellets that are capable of passing through an ASTM No. 40 U.S.A. standard testing sieve, but incapable of passing through an ASTM No. 80 U.S.A. standard testing sieve. Such dense sintered carbide pellets may have an average diameter of less than about 425 microns and greater than about 180 microns. The average diameter of the dense sintered carbide pellets 56 may be between about 0.4 times and about 10 times greater than the average diameter of the carbide granules 58 or pellets 59. The carbide granules 58 may include −16 ASTM mesh granules. As used herein, the phrase "−16 ASTM mesh granules" means granules that are capable of passing through an ASTM No. 16 U.S.A. standard testing sieve. More particularly, the carbide granules 58 may include −100 ASTM mesh granules. As used herein, the phrase "−100 ASTM mesh granules" means granules that are capable of passing through an ASTM No. 100 U.S.A. standard testing sieve. Such cast carbide granules may have an average diameter of less than about 150 microns.

As an example, the dense sintered carbide pellets 56 may include −45/+70 ASTM mesh pellets, and the carbide granules 58 may include −100/+325 ASTM mesh granules. As used herein, the phrase "−45/+70 ASTM mesh pellets" means pellets that are capable of passing through an ASTM No. 45 U.S.A. standard testing sieve, but incapable of passing through an ASTM No. 70 U.S.A. standard testing sieve. Such dense sintered carbide pellets 59 may have an average diameter of less than about 355 microns and greater than about 212 microns. Furthermore, the phrase "−100/+325 ASTM mesh granules," as used herein, means granules capable of passing through an ASTM No. 100 U.S.A. standard testing sieve, but incapable of passing through an ASTM No. 325 U.S.A. standard testing sieve. Such carbide granules 58 may have an average diameter in a range from approximately 45 microns to about 150 microns.

As another example, the plurality of dense sintered carbide pellets 56 may include a plurality of −60/+80 ASTM mesh dense sintered carbide pellets and a plurality of −16/+270 ASTM mesh sintered tungsten carbide granules. The plurality of −60/+80 ASTM mesh dense sintered carbide pellets may comprise between about 10% and about 45% by weight of the abrasive wear-resistant material 54, and the plurality of −16/+270 ASTM mesh sintered carbide pellets may comprise less than about 35% by weight of the abrasive wear-resistant material 54. As used herein, the phrase "−16/+270 ASTM mesh pellets" means pellets capable of passing through an ASTM No. 16 U.S.A. standard testing sieve, but incapable of passing through an ASTM No. 270 U.S.A. standard testing sieve. Such dense sintered carbide pellets 56 may have an average diameter in a range from approximately 180 microns to about 250 microns.

As yet another example, the plurality of dense sintered carbide pellets 56 may include a plurality of −40/+80 ASTM mesh dense sintered carbide pellets. The plurality of −40/+80 ASTM mesh dense sintered carbide pellets may comprise about 35% by weight of the abrasive wear-resistant material 54 and the matrix material 60 may be about 65% by weight of the abrasive wear-resistant material 54.

In one particular embodiment, set forth merely as an example, the abrasive wear-resistant material 54 may include about 40% by weight matrix material 60, about 48% by weight −40/+80 ASTM mesh dense sintered carbide pellets 56, and about 12% by weight −140/+325 ASTM mesh carbide granules 58. As used herein, the phrase "−40/+80 ASTM mesh pellets" means pellets that are capable of passing through an ASTM No. 40 U.S.A. standard testing sieve, but incapable of passing through an ASTM No. 80 U.S.A. standard testing sieve. Similarly, the phrase "−140/+325 ASTM mesh pellets" means carbide granules that are capable of passing through an ASTM No. 140 U.S.A. standard testing sieve, but incapable of passing through an ASTM No. 325 U.S.A. standard testing sieve. The matrix material 60 may include a nickel-based alloy, which may further include one or more additional elements such as, for example, chromium, boron, and silicon. The matrix material 60 also may have a melting point of less than about 1100° C., and may exhibit a hardness of between about 20 and about 55 on the Rockwell C Scale. More particularly, the matrix material 60 may exhibit a hardness of between about 35 and about 50 on the Rockwell C Scale. For example, the matrix material 60 may exhibit a hardness of about 40 on the Rockwell C Scale.

Cast granules and sintered pellets of carbides other than tungsten carbide also may be used to provide abrasive wear-resistant materials that embody teachings of the invention. Such other carbides include, but are not limited to, chromium carbide, molybdenum carbide, niobium carbide, tantalum carbide, titanium carbide, and vanadium carbide.

The matrix material 60 may comprise a metal alloy material having a melting point that is less than about 1100° C. Furthermore, each dense sintered carbide pellet 56 of the plurality of dense sintered carbide pellets 56 may comprise a plurality of tungsten carbide particles bonded together with a binder alloy having a melting point that is greater than about 1200° C. For example, the binder alloy may comprise a cobalt-based metal alloy material or a nickel-based alloy material having a melting point that is lower than about 1200° C. In this configuration, the matrix material 60 may be substantially melted during application of the abrasive wear-resistant material 54 to a surface of a drilling tool such as a drill bit without substantially melting the carbide granules 58, or the binder alloy or the tungsten carbide particles of the dense sintered carbide pellets 56. This enables the abrasive wear-resistant material 54 to be applied to a surface of a drilling tool at relatively lower temperatures to minimize dissolution between the dense sintered carbide pellets 56 and the matrix material 60 and between the carbide granules 58 and the matrix material 60.

As previously discussed herein, minimizing atomic diffusion between the matrix material 60 and the dense sintered carbide pellets 56 and carbide granules 58, helps to preserve the chemical composition and the physical properties of the matrix material 60, the dense sintered carbide pellets 56, and the carbide granules 58 during application of the abrasive wear-resistant material 54 to the surfaces of drill bits and other tools.

The matrix material 60 also may include relatively small amounts of other elements, such as carbon, chromium, silicon, boron, iron, and nickel. Furthermore, the matrix material 60 also may include a flux material such as silicomanganese, an alloying element such as niobium, and a binder such as a polymer material.

Figure 22:
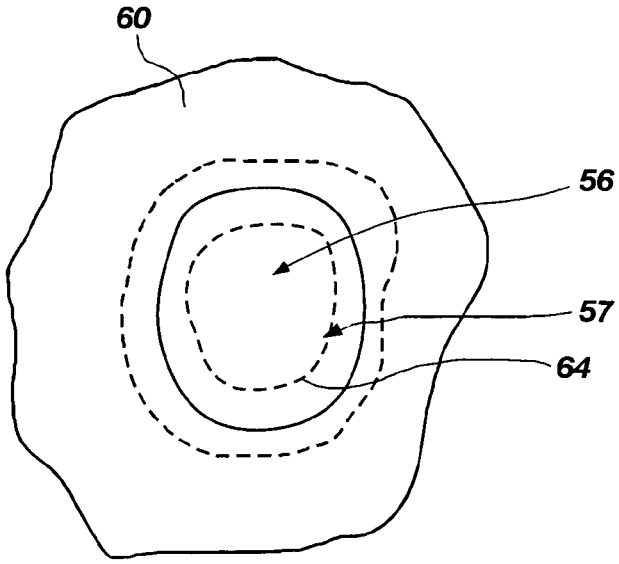
FIG. 22 is an enlarged view of a dense sintered carbide pellet shown in FIG. 21.

FIG. 22 is an enlarged view of a dense sintered carbide pellet 56 shown in FIG. 21. The hardness of the dense sintered carbide pellet 56 may be substantially consistent throughout the pellet. For example, the dense sintered carbide pellet 56 may include a peripheral or outer region 57 of the dense sintered carbide pellet 56. The outer region 57 may roughly include the region of the dense sintered carbide pellet 56 outside the phantom line 64. The dense sintered carbide pellet 56 may exhibit a first average hardness in the central region of the pellet enclosed by the phantom line 64, and a second average hardness at locations within the peripheral region 57 of the pellet outside the phantom line 64. The second average hardness of the dense sintered carbide pellet 56 may be greater than about 99% of the first average hardness of the dense sintered carbide pellet 56. As an example, the first average hardness may be about 90 to 92 on the Rockwell A Scale and the second average hardness may be about 90 on the Rockwell A Scale for a nickel-based matrix material and may be about 86 on the Rockwell A Scale for an iron-based matrix material.

The dense sintered carbide pellets 56 may have relatively high fracture toughness relative to the carbide granules 58, while the carbide granules 58 may have relatively high hardness relative to the dense sintered carbide pellets 56. By using matrix materials 60 as described herein, the fracture toughness of the dense sintered carbide pellets 56 and the hardness of the carbide granules 58 may be preserved in the abrasive wear-resistant material 54 during application of the abrasive wear-resistant material 54 to a drill bit or other drilling tool, providing an abrasive wear-resistant material 54 that is improved relative to abrasive wear-resistant materials known in the art.

Abrasive wear-resistant materials according to embodiments of the invention, such as the abrasive wear-resistant material 54 illustrated in FIGS. 21, 23A, and 23B, may be applied to selected areas on surfaces of rotary drill bits (such as the rotary drill bit 10 shown in FIG. 1), rolling cutter drill bits (commonly referred to as "roller cone" drill bits), and other drilling tools that are subjected to wear, such as ream while drilling tools and expandable reamer blades, all such apparatuses and others being encompassed, as previously indicated, within the term "drill bit."

Certain locations on a surface of a drill bit may require relatively higher hardness, while other locations on the surface of the drill bit may require relatively higher fracture toughness. The relative weight percentages of the matrix material 60, the plurality of dense sintered carbide pellets 56, and the optional plurality of carbide granules 58 may be selectively varied to provide an abrasive wear-resistant material 54 that exhibits physical properties tailored to a particular tool or to a particular area on a surface of a tool.

In addition to being applied to selected areas on surfaces of drill bits and drilling tools that are subjected to wear, the abrasive wear-resistant materials according to embodiments of the invention may be used to protect structural features or materials of drill bits and drilling tools that are relatively more prone to wear, including the examples presented above.

The abrasive wear-resistant material 54 may be used to cover and protect interfaces between any two structures or features of a drill bit or other drilling tool, for example, the interface between a bit body and a periphery of wear knots or any type of insert in the bit body. In addition, the abrasive wear-resistant material 54 is not limited to use at interfaces between structures or features and may be used at any location on any surface of a drill bit or drilling tool that is subjected to wear, such as on surfaces of the bit body about the nozzle's outlets, within the junk slots 116, and between cutting elements 118, for example, and without limitation.

Abrasive wear-resistant materials according to embodiments of the invention, such as the abrasive wear-resistant material 54, may be applied to the selected surfaces of a drill bit or drilling tool using variations of techniques known in the art. For example, a pre-application abrasive wear-resistant material according to embodiments of the invention may be provided in the form of a welding rod. The welding rod may comprise a solid, cast or extruded rod consisting of the abrasive wear-resistant material 54. Alternatively, the welding rod may comprise a hollow cylindrical tube formed from the matrix material 60 and filled with a plurality of dense sintered carbide pellets 56 and a plurality of carbide granules 58. An OAW torch or any other type of gas fuel torch may be used to heat at least a portion of the welding rod to a temperature above the melting point of the matrix material 60. This may minimize the extent of atomic diffusion occurring between the matrix material 60 and the dense sintered carbide pellets 56 and carbide granules 58.

The rate of dissolution occurring between the matrix material 60 and the dense sintered carbide pellets 56 and carbide granules 58 is at least partially a function of the temperature at which dissolution occurs. The extent of dissolution, therefore, is at least partially a function of both the temperature at which dissolution occurs and the time for which dissolution is allowed to occur. Therefore, the extent of dissolution occurring between the matrix material 60 and the dense sintered carbide pellets 56 and carbide granules 58 may be controlled by employing good heat management control.

An OAW torch may be capable of heating materials to temperatures in excess of 1200° C. It may be beneficial to slightly melt the surface of the drill bit or drilling tool to which the abrasive wear-resistant material 54 is to be applied just prior to applying the abrasive wear-resistant material 54 to the surface. For example, the OAW torch may be brought in close proximity to a surface of a drill bit or drilling tool and used to heat to the surface to a sufficiently high temperature to slightly melt or "sweat" the surface. The welding rod comprising pre-application wear-resistant material may then be brought in close proximity to the surface and the distance between the torch and the welding rod may be adjusted to heat at least a portion of the welding rod to a temperature above the melting point of the matrix material 60 to melt the matrix material 60. The molten matrix material 60, at least some of the dense sintered carbide pellets 56, and at least some of the carbide granules 58 may be applied to the surface of the drill bit, and the molten matrix material 60 may be solidified by controlled cooling. The rate of cooling may be controlled to control the microstructure and physical properties of the abrasive wear-resistant material 54.

Alternatively, the abrasive wear-resistant material 54 may be applied to a surface of a drill bit or drilling tool using an arc welding technique, such as a plasma-transferred arc welding technique. For example, the matrix material 60 may be provided in the form of a powder (small particles of matrix material 60). A plurality of dense sintered carbide pellets 56 and a plurality of carbide granules 58 may be mixed with the powdered matrix material 60 to provide a pre-application wear-resistant material in the form of a powder mixture. A plasma-transferred arc welding machine then may be used to heat at least a portion of the pre-application wear-resistant material to a temperature above the melting point of the matrix material 60 and less than about 1200° C. to melt the matrix material 60.

All arc methods, whether continuous or pulsed arc, may be utilized with embodiments of the invention. Other welding techniques, such as metal inert gas (MIG) arc welding techniques, tungsten inert gas (TIG) arc welding techniques, and flame spray welding techniques are known in the art and may be used to apply the abrasive wear-resistant material 54 to a surface of a drill bit or drilling tool. Still other techniques may include plasma transferred arc (PTA) and submerged arc. The arc methods may include application by way of powder, wire or tube feed mechanisms. As the above arc methods for applying the abrasive wear-resistant material 54 are merely illustrative, and are not a limitation to the methods herein presented.

The abrasive wear-resistant material, i.e., hardfacing, is suitable for application upon a bit body made from steel material, particle-matrix composite material or so called "cemented carbide" material. Particle-matrix composite material for a bit body is disclosed in U.S. application Ser. No. 11/272,439, filed Nov. 10, 2005, now U.S. Pat. No. 7,776,256, issued Aug. 17, 2010, the disclosure of which application is incorporated herein in its entirety by this reference.

While the invention has been described herein with respect to certain embodiments, those of ordinary skill in the art will recognize and appreciate that it is not so limited. Rather, many additions, deletions and modifications to the embodiments may be made without departing from the scope of the invention as hereinafter claimed. In addition, features from one embodiment may be combined with features of another embodiment while still being encompassed within the scope of the invention as contemplated by the inventors. Further, the invention has utility in drill bits and core bits having different and various bit profiles as well as cutting element types.

What is claimed is:

1. An abrasive wear-resistant material comprising the following materials in pre-application ratios:

a matrix material forming a portion of a core of a welding rod for use in the application of abrasive wear-resistant material, the matrix material comprising between about 20% and about 75% by weight of the abrasive wear-resistant material; and a plurality of −40/+80 ASTM mesh dense sintered carbide pellets substantially randomly dispersed throughout the matrix material forming a portion of the core of the welding rod, the plurality of dense sintered carbide pellets comprising between about 25% and about 70% by weight of the abrasive wear-resistant material, wherein each pellet of the plurality of dense sintered carbide pellets has a first average hardness in a central region of the pellet and a second average hardness in a peripheral region of the pellet, the second average hardness being greater than about 99% of the first average hardness, the first average hardness and the second average hardness being different.

2. The abrasive wear-resistant material of claim 1, further comprising a plurality of −16 ASTM mesh carbide granules substantially randomly dispersed throughout the matrix material, the plurality of carbide granules comprising less than about 35% by weight of the abrasive wear-resistant material.

3. The abrasive wear-resistant material of claim 1, wherein the matrix material comprises at least 75% nickel by weight and having a melting point of less than about 1100° C.; and wherein each dense sintered carbide pellet comprises a plurality of dense sintered carbide particles bonded together with a binder alloy, the binder alloy having a melting point greater than about 1200° C.

4. The abrasive wear-resistant material of claim 2, wherein the plurality of −40/+80 ASTM mesh dense sintered carbide pellets comprises a plurality of −45/+70 ASTM mesh dense sintered carbide pellets, and wherein the plurality of −16 ASTM mesh carbide granules comprises a plurality of −100/+325 ASTM mesh cast tungsten carbide pellets.

5. The abrasive wear-resistant material of claim 2, wherein the plurality of −40/+80 ASTM mesh dense sintered carbide pellets comprises a plurality of −60/+80 ASTM mesh dense sintered carbide pellets and wherein the plurality of −16 ASTM mesh carbide granules comprises a plurality of −140/+325 ASTM mesh carbide pellets and a plurality of −16 ASTM mesh spherical sintered carbide pellets, the plurality of −60/+80 ASTM mesh dense sintered carbide pellets comprising between about 25% and about 35% by weight of the abrasive wear-resistant material, the plurality of −140/+325 ASTM mesh carbide pellets and a plurality of −16 ASTM mesh spherical sintered carbide pellets comprising between about 10% and about 15% by weight of the abrasive wear-resistant material.

6. A rotary drill bit for drilling at least one subterranean formation, the rotary drill bit comprising:

a bit body substantially formed of a material comprising one of steel material, particle-matrix composite material and cemented matrix material, the bit body comprising:

an exterior surface;

a plurality of blades; and at least one groove extending longitudinally into at least one blade of the plurality of blades, the at least one groove extending along an edge defined by an intersection between a formation engaging surface and at least one of a rotationally leading surface and a rotationally trailing surface of the at least one blade of the plurality of blades, the at least one groove extending into the at least one blade of the plurality of blades only substantially along the intersection; and an abrasive wear-resistant material disposed in the at least one groove, the abrasive wear-resistant material comprising:

a matrix material; and a plurality of −40/+80 ASTM mesh dense sintered carbide pellets substantially randomly dispersed throughout the matrix material.

7. The rotary drill bit of claim 6, wherein the abrasive wear-resistant material is diposed in at least one recess extending into the bit body from the exterior surface, the exposed surfaces of the abrasive wear-resistant material being substantially level with the exterior surface of the bit body adjacent the abrasive wear-resistant material, taken in a direction generally perpendicular to the exterior surface of the bit body adjacent the abrasive wear-resistant material.

8. The rotary drill bit of claim 6, wherein the abrasive wear-resistant material disposed on the exterior surface of the bit body comprises the following materials in pre-application ratios:

a matrix material, the matrix material comprising between about 20% and about 75% by weight of the abrasive wear-resistant material, the matrix material comprising at least 75% nickel by weight, the matrix material having a melting point of less than about 1100° C.; and wherein the plurality of dense sintered carbide pellets comprises between about 25% and about 70% by weight of the abrasive wear-resistant material, each dense sintered carbide pellet comprising a plurality of tungsten carbide particles bonded together with a binder alloy, the binder alloy having a melting point greater than about 1200° C.

9. The rotary drill bit of claim 8, further comprising a plurality of −16 ASTM mesh carbide granules substantially randomly dispersed throughout the matrix material, the plurality of carbide granules comprising less than about 35% by weight of the abrasive wear-resistant material.

10. The rotary drill bit of claim 6, further comprising at least one cutting element secured to the bit body along an interface; a brazing alloy disposed between the bit body and the at least one cutting element at the interface, the brazing alloy securing the at least one cutting element to the bit body, at least a continuous portion of the abrasive wear-resistant material being bonded to an exterior surface of the bit body and a surface of the at least one cutting element and extending over the interface between the bit body and the at least one cutting element and covering at least a portion of the brazing alloy.

11. The rotary drill bit of claim 10, wherein the bit body comprises a pocket in the exterior surface of the bit body, at least a portion of the at least one cutting element being disposed within the pocket, the interface extending along adjacent surfaces of the bit body and the at least one cutting element, and wherein the bit body further comprises at least one recess formed in the exterior surface of the bit body adjacent the interface, at least a portion of the abrasive wear-resistant material being disposed within the at least one recess.

12. The rotary drill bit of claim 9, wherein the plurality of −40/+80 ASTM mesh dense sintered carbide pellets comprises a plurality of −60/+80 ASTM mesh dense sintered carbide pellets, and wherein the plurality of −16 ASTM mesh carbide granules comprises a plurality of −100/+325 ASTM mesh carbide pellets and a plurality of −16 ASTM mesh spherical sintered carbide pellets, the plurality of −60/+80 ASTM mesh dense sintered carbide pellets comprising between about 25% and about 35% by weight of the abrasive wear-resistant material, the plurality of −100/+325 ASTM mesh carbide pellets and the plurality of −16 ASTM mesh spherical sintered carbide pellets comprising between about 10% and about 15% by weight of the abrasive wear-resistant material.

13. The rotary drill bit of claim 6, wherein each dense sintered carbide pellet of the abrasive wear-resistant material has a first average hardness in a central region of the pellet and a second hardness in a peripheral region of the pellet, the second hardness being greater than about 99% of the first hardness.

14. The rotary drill bit of claim 13, wherein the first average hardness and the second hardness are greater than about 89 on a Rockwell A hardness scale.

15. The rotary drill bit of claim 6, wherein the plurality of −40/+80 ASTM mesh dense sintered carbide pellets comprises a plurality of −45/+70 ASTM mesh dense sintered carbide pellets.

16. The rotary drill bit of claim 6, wherein the plurality of −40/+80 ASTM mesh dense sintered carbide pellets comprises a plurality of −60/+80 ASTM mesh dense sintered carbide pellets.

* * * * *